US011396203B2

(12) United States Patent
Hayakawa

(10) Patent No.: US 11,396,203 B2
(45) Date of Patent: Jul. 26, 2022

(54) KNOCK TYPE WRITING TOOL

(71) Applicant: KABUSHIKI KAISHA PILOT CORPORATION, Tokyo (JP)

(72) Inventor: Hisatoshi Hayakawa, Tokyo (JP)

(73) Assignee: KABUSHIKI KAISHA PILOT CORPORATION, Tokyo (JP)

( * ) Notice: Subject to any disclaimer, the term of this patent is extended or adjusted under 35 U.S.C. 154(b) by 0 days.

(21) Appl. No.: 17/296,276

(22) PCT Filed: Oct. 4, 2019

(86) PCT No.: PCT/JP2019/039235

§ 371 (c)(1),
(2) Date: May 24, 2021

(87) PCT Pub. No.: WO2020/110461

PCT Pub. Date: Jun. 4, 2020

(65) Prior Publication Data

US 2022/0009271 A1 Jan. 13, 2022

(30) Foreign Application Priority Data

Nov. 29, 2018 (JP) ..... JP2018-224286
Jun. 7, 2019 (JP) ..... JP2019-107514

(51) Int. Cl.
*B43K 24/08* (2006.01)
*B43K 7/00* (2006.01)
*B43K 24/04* (2006.01)

(52) U.S. Cl.
CPC ..... *B43K 24/084* (2013.01); *B43K 7/005* (2013.01); *B43K 24/04* (2013.01); *B43K 24/082* (2013.01)

(58) Field of Classification Search
CPC . B43K 7/01; B43K 7/02; B43K 24/08; B43K 24/082; B43K 24/084; B43K 24/086
See application file for complete search history.

(56) References Cited

U.S. PATENT DOCUMENTS 3,318,289 A 5/1967 Marynissen
4,669,904 A * 6/1987 Kageyama ..... B43K 24/03 401/109

(Continued)

FOREIGN PATENT DOCUMENTS

JP 1178361 A 3/1999
JP 200417397 A 1/2004

(Continued)

OTHER PUBLICATIONS

Written Opinion of the International Search Authority for PCT/JP2019/039235, dated Nov. 12, 2019.

*Primary Examiner* — David P Angwin
*Assistant Examiner* — Bradley S Oliver
(74) *Attorney, Agent, or Firm* — Renner, Kenner, Greive, Bobak, Taylor & Weber

(57) ABSTRACT

A knock type writing tool is provided, in which an appropriate amount of air can be taken in depending on an amount of a thermochromic ink discharged from a pen tip, so that the thermochromic ink can be smoothly discharged from the pen tip, and in which a writing body can rotate surely in conjunction with a rotation of a rotating member. An air hole 63*a* and a plurality of projection pieces 63*b* are provided at a rear end portion of a writing body 6. A front surface of a projection and retraction rotating member 7 is provided with a plurality of abutment parts 73, on which respective rear ends of the plurality of projection pieces 63*b* are to abut, and with a plurality of protrusion parts 72, each of which is formed between the plurality of abutment parts 73 and protruded more forward than the plurality of abutment parts 73. The protrusion parts 72 are respectively inserted in gaps 63*c* between the projection pieces 63*b*. An axial length of each projection piece 63*b* is longer than an axial length of (Continued)

each protrusion part 72, so that a portion of the gap 63*c* is left more forward than a front end of each protrusion part 72.

9 Claims, 31 Drawing Sheets

(56) References Cited

U.S. PATENT DOCUMENTS

| | | | | |
|---|---|---|---|---|
| 5,417,504 | A * | 5/1995 | Andrews | B43K 24/084 401/110 |
| 7,524,123 | B1 * | 4/2009 | Cote | B43K 29/007 401/99 |
| 8,322,937 | B2 * | 12/2012 | Imamura | B43K 7/08 401/99 |
| 9,108,456 | B2 * | 8/2015 | Ito | B43K 7/08 |
| 9,636,940 | B2 * | 5/2017 | Kamitani | B43K 7/08 |
| 10,538,124 | B2 * | 1/2020 | Ito | B43K 24/082 |
| 10,576,775 | B2 * | 3/2020 | Namiki | B43K 7/12 |
| 10,787,022 | B2 * | 9/2020 | Soejima | B43K 24/08 |
| 2002/0192007 | A1 * | 12/2002 | Lee | B43K 5/1863 401/117 |
| 2007/0189836 | A1 * | 8/2007 | Senga | B43K 23/12 401/215 |

FOREIGN PATENT DOCUMENTS

| | | | |
|---|---|---|---|
| JP | 201465188 | A | 4/2014 |
| JP | 2018108662 | A | 7/2018 |

* cited by examiner

KNOCK TYPE WRITING TOOL

TECHNICAL FIELD

The present invention pertains to a knock type writing tool including a writing body in which a thermochromic ink is contained.

BACKGROUND ART

Conventionally, there has been known a knock type writing tool in which a pen tip projects or retracts every time a knock member is pressed forward.

Such a knock type ballpoint pen has been disclosed in Patent Document 1. The knock type ballpoint pen is provided with a rotating cam member configured to cause a pen tip to project and retract. A protrusion part, which is configured to be inserted into a rear end opening of an ink containing tube, and an abutment part, which is configured to abut on a rear end of the ink containing tube, are provided on a front surface of the rotating cam member. A tapered press part, which is configured to be pressed onto an inner circumferential edge portion of the rear end opening of the ink containing tube, is provided on an outer surface of the protrusion part. Thus, the outer surface of the protrusion part ahead of the press part is in a noncontact state with an inner surface of the ink containing tube. In addition, a cutout part extending in a front and rear direction is provided at a portion of the press part, and a concave part communicating with the cutout part is provided at a portion of the abutment part. This, under a state wherein the abutment part of the rotating cam member and the rear end of the ink containing tube are in contact with each other, due to the cutout part and the concave part, an air passage is formed such that the inside of the ink containing tube and the outside thereof are communicated. Thus, air replacement for an ink in the ink containing tube is made smoother, and thus smoother ink discharging performance can be obtained.

Furthermore, recently, there has been known a knock type writing tool in which a pen tip is rotated every time a knock member is pressed forward, in addition to the feature wherein the pen tip projects and retracts. Such a writing tool, whose pen tip is rotated, is popular in the market because wear of the pen tip can be equalized.

Such a knock type writing tool has been disclosed in Patent Document 2. In the writing tool, a refill is rotated in conjunction with a rotation of a rotating cam for the purpose of avoiding uneven wear of a pen tip. In addition, in the structural example shown in Patent Document 2, an engaged part carved in a V shape in a circumferential direction is formed at a head end surface of a tail plug of the refill, and an engaging part carved in an inversed V shape in the circumferential direction is formed at a leading end surface of the rotating cam so as to engage with the engaged part.

PRIOR ART DOCUMENT

Patent Document List

Patent Document 1 is JP-A-2004-17397.
Patent Document 2 is JP-A-H11(1999)-78361.

SUMMARY OF INVENTION

Technical Problem

When a thermochromic ink is used, an amount of the ink discharged from a pen tip is relatively larger. Thus, when the structure disclosed in Patent Document 1 is applied to a writing tool using a thermochromic ink, air may not be taken sufficiently from the outside of the ink containing tube into the inside thereof, so that smooth ink discharging performance from the pen tip may not be obtained (interruption of handwriting may be caused).

In the same way, when the structure disclosed in Patent Document 2 is applied to a writing tool using a thermochromic ink, it is difficult to provide a large air passage which communicates the inside of the refill with the outside thereof, so that smooth ink discharging performance from the pen tip may not be obtained (interruption of handwriting may be caused).

An object of the present invention is to solve the above problems. That is to say, an object of the present invention is to provide a knock type writing tool using a thermochromic ink in which smooth ink discharging performance from a pen tip is obtained and in which the pen tip is rotated every time a knock member is operated.

In the present disclosure, the term "front" means a pen-tip side, and the term "rear" means an opposite side thereof.

Solution to Problem

According to the first aspect of the present invention, a knock type writing tool is provided, the knock type writing tool including: a writing body having a pen tip at a front end thereof, a thermochromic ink in an inside thereof, and an air hole at a rear end thereof, the air hole communicating with a space in which the thermochromic ink is contained (a follower may be interposed in the middle); a shaft cylinder configured to contain the writing body in such a manner that the writing body is movable in a front and rear direction with respect to the shaft cylinder; a knock member provided on an outer surface of the shaft cylinder in such a manner that the knock member is movable in a front and rear direction with respect to the shaft cylinder; a projection and retraction rotating member configured to move in a front and rear direction to cause the pen tip to project from or retract within a front end of the shaft cylinder and configured to cause the writing body to rotate, every time the knock member is moved forward; and a cam part provided in the shalt cylinder, the cam part being able to engage or disengage with the projection and retraction rotating member depending on a position of the knock member; wherein a plurality of projection pieces, each of which is projected rearward, are provided at a rear end of the writing body, the plurality of projection pieces being arranged circumferentially apart from each other; a plurality of gaps between the plurality of projection pieces communicate with the air hole; a front portion of the projection and retraction rotating member is provided with a plurality of abutment parts, on which respective rear ends of the plurality of projection pieces are to abut, and with a plurality of protrusion parts, each of which is protruded more forward than the plurality of abutment parts; the plurality of protrusion parts are respectively inserted in the plurality of gaps between the plurality of projection pieces; and a portion of each of the plurality of gaps is left in front of each of the plurality of protrusion parts.

According to the above structure, the plurality of gaps between the plurality of projection pieces can be secured sufficiently. Thus, an appropriate amount of air can be taken in depending on an amount of the thermochromic ink discharged from the pen tip, so that the thermochromic ink can be smoothly discharged from the pen tip.

For example, the shalt cylinder is configured to contain the writing body in such a manner that the writing body is movable in the front and rear direction with respect to the shaft cylinder under a state in which the writing body is biased rearward; the projection and retraction rotating member is configured to move in the front and rear direction, in conjunction with a movement of the knock member in the front and rear direction; and the projection and retraction rotating member is configured to move forward together with the knock member and to cause the pen tip to project from or retract within the front end of the shaft cylinder, every time the knock member is moved forward.

In this case, as the knock member is also affected by a force for biasing the writing body rearward, the knock member can be automatically returned, which can provide a good operation feeling and a good operability.

In addition, it is preferable that the plurality of projection pieces and the plurality of protrusion parts are configured to circumferentially engage with each other in such a manner that the writing body rotates in conjunction with a rotation of the projection and retraction rotating member.

According to this feature, although the structure is simple, circumferential engagement of the projection and retraction rotating member with the writing body can be surely obtained.

In addition, in this case, it is further preferable that engagement surfaces of the plurality of projection pieces against the plurality of protrusion parts and engagement surfaces of the plurality of protrusion parts against the plurality of projection pieces extend substantially in parallel in a front and rear direction.

According to this feature, the respective engagement surfaces are engaged more efficiently, so that the circumferential engagement of the projection and retraction rotating member with the writing body can be obtained more surely.

In addition, it is preferable that a front portion of the projection and retraction rotating member is connected to an annular auxiliary protrusion part provided integrally with the plurality of protrusion parts.

According to this feature, the plurality of protrusion parts are effectively reinforced, which can prevent breakage of the plurality of protrusion parts or the like.

In addition, it is preferable that an inside surface of the annular auxiliary protrusion part is a tapered auxiliary abutment surface, and a rear end portion of the writing body is provided with an auxiliary tapered portion on which the auxiliary abutment surface is to abut.

According to this feature, the rear end portion of the writing body can be supported more stably by using the tapered auxiliary abutment surface. Furthermore, since the auxiliary abutment surface and the auxiliary tapered portion are tapered, a so-called "centering" effect can be obtained.

In addition, it is preferable that the plurality of projection pieces are formed of polypropylene resin or polyethylene resin.

According to this feature, the plurality of projection pieces can have sufficient strength, so that bending or buckling thereof can be effectively prevented. Thus, a stable rotation of the writing body can be obtained in conjunction with a rotation of the projection and retraction rotating member.

In addition, according to the second aspect of the present invention, a knock type writing tool is provided, the knock type writing tool including: a writing body having a pen tip at a front end thereof, a thermochromic ink in an inside thereof, and an air hole at a rear end thereof, the air hole communicating with a space in which the thermochromic ink is contained (a follower may be interposed in the middle); a shaft cylinder configured to contain the writing body in such a manner that the writing body is movable in a front and rear direction with respect to the shaft cylinder; a knock member provided on an outer surface of the shaft cylinder in such a manner that the knock member is movable in a front and rear direction with respect to the shaft cylinder; a projection and retraction rotating member configured to move in a front and rear direction to cause the pen tip to project from or retract within a front end of the shaft cylinder and configured to cause the writing body to rotate, every time the knock member is moved forward; and a cam part provided in the shaft cylinder, the cam part being able to engage or disengage with the projection and retraction rotating member depending on a position of the knock member; wherein a plurality of protrusion parts, each of which is protruded forward, are provided at a front portion of the projection and retraction rotating member, the plurality of protrusion parts being arranged circumferentially apart from each other; a rear end of the writing body is provided with a plurality of abutment parts, on which respective front ends of the plurality of protrusion parts are to abut, and with a plurality of projection pieces, each of which is projected more rearward than the plurality of abutment parts; the plurality of projection pieces are respectively inserted in a plurality of gaps between the plurality of protrusion parts; and a portion of each of the plurality of gaps is left behind each of the plurality of projection pieces.

According to the above structure, the plurality of gaps between the plurality of protrusion parts can be secured sufficiently. Thus, an appropriate amount of air can be taken in depending on an amount of the thermochromic ink discharged from the pen tip, so that the thermochromic ink can be smoothly discharged from the pen tip.

In addition, according to the third aspect of the present invention, a knock type writing tool is provided, the knock type writing tool including: a writing body having a pen tip at a front end thereof, a thermochromic ink in an inside thereof, and an air hole at a rear end thereof, the air hole communicating with a space in which the thermochromic ink is contained (a follower may be interposed in the middle); a shaft cylinder configured to contain the writing body in such a manner that the writing body is movable in a front and rear direction with respect to the shaft cylinder; a knock member provided on an outer surface of the shaft cylinder in such a manner that the knock member is movable in a front and rear direction with respect to the shaft cylinder; a projection and retraction rotating member configured to move in a front and rear direction to cause the pen tip to project from or retract within a front end of the shaft cylinder and configured to cause the writing body to rotate, every time the knock member is moved forward; and a cam part provided in the shaft cylinder, the cam part being able to engage or disengage with the projection and retraction rotating member depending on a position of the knock member; wherein a plurality of protrusion parts, each of which is protruded forward, are provided at a front portion of the projection and retraction rotating member; a rear end of the writing body is provided with a flexible member which is elastically deformable; the flexible member is made of a porous material; and the plurality of protrusion parts and the flexible member are configured to circumferentially engage with each other when the plurality of protrusion parts cause the flexible member to elastically deform and sink in an inside of the flexible member in such a manner that the writing body rotates in conjunction with a rotation of the projection and retraction rotating member.

According to the above structure, due to the flexible member made of a porous material, air permeability can be secured sufficiently. Thus, an appropriate amount of air can be taken in depending on an amount of the thermochromic ink discharged from the pen tip, so that the thermochromic ink can be smoothly discharged from the pen tip. In addition, the flexible member can absorb an impact and/or a force applied to the writing body at the time of writing, and thus it is possible to provide a user with a soft and comfortable writing feeling.

In addition, according to the fourth aspect of the present invention, a knock type writing tool is provided, the knock type writing tool including: a writing body having a pen tip at a front end thereof, a thermochromic ink in an inside thereof, and an air hole at a rear end thereof, the air hole communicating with a space in which the thermochromic ink is contained (a follower may be interposed in the middle); a shaft cylinder configured to contain the writing body in such a manner that the writing body is movable in a front and rear direction with respect to the shaft cylinder; a knock member provided on an outer surface of the shaft cylinder in such a manner that the knock member is movable in a front and rear direction with respect to the shaft cylinder; a projection and retraction rotating member configured to move in a front and rear direction to cause the pen tip to project from or retract within a front end of the shaft cylinder and configured to cause the writing body to rotate, every time the knock member is moved forward; and a cam part provided in the shaft cylinder, the cam part being able to engage or disengage with the projection and retraction rotating member depending on a position of the knock member; wherein a plurality of protrusion parts, each of which is protruded forward, are provided at a front portion of the projection and retraction rotating member; a rear end of the writing body is provided with a flexible member which is elastically deformable; the flexible member is provided with a connection air hole configured to communicate with the air hole, the connection air hole being opened at a rear end or a lateral surface of the flexible member; and the plurality of protrusion parts and the flexible member are configured to circumferentially engage with each other when the plurality of protrusion parts cause the flexible member to elastically deform and sink in an inside of the flexible member in such a manner that the writing body rotates in conjunction with a rotation of the projection and retraction rotating member.

According to the above structure, the connection air hole can be secured sufficiently. Thus, an appropriate amount of air can be taken in depending on an amount of the thermochromic ink discharged from the pen tip, so that the thermochromic ink can be smoothly discharged from the pen tip.

In addition, according to the fifth aspect of the present invention, a knock type writing tool is provided, the knock type writing tool including: a writing body having a pen tip at a front end thereof, a thermochromic ink in an inside thereof, and an air hole at a rear end thereof, the air hole communicating with a space in which the thermochromic ink is contained (a follower may be interposed in the middle); a shaft cylinder configured to contain the writing body in such a manner that the writing body is movable in a front and rear direction with respect to the shaft cylinder; a knock member provided on an outer surface of the shaft cylinder in such a manner that the knock member is movable in a front and rear direction with respect to the shaft cylinder; a projection and retraction rotating member configured to move in a front and rear direction to cause the pen tip to project from or retract within a front end of the shaft cylinder and configured to cause the writing body to rotate, every time the knock member is moved forward; and a cam part provided in the shaft cylinder, the cam part being able to engage or disengage with the projection and retraction rotating member depending on a position of the knock member; wherein a plurality of projection pieces, each of which is projected rearward, are provided at a rear end of the writing body, the plurality of projection pieces being arranged circumferentially apart from each other; a plurality of gaps between the plurality of projection pieces communicate with the air hole; a front portion of the projection and retraction rotating member is provided with a flexible member which is elastically deformable; the flexible member is made of a porous material; and the plurality of projection pieces and the flexible member are configured to circumferentially engage with each other when at least a portion on a rear side of the plurality of projection pieces causes the flexible member to elastically deform and sinks in an inside of the flexible member in such a manner that the writing body rotates in conjunction with a rotation of the projection and retraction rotating member.

According to the above structure, due to the flexible member made of a porous material, air permeability can be secured sufficiently. Thus, an appropriate amount of air can be taken in depending on an amount of the thermochromic ink discharged from the pen tip, so that the thermochromic ink can be smoothly discharged from the pen tip. In addition, the flexible member can absorb an impact and/or a force applied to the writing body at the time of writing, and thus it is possible to provide a user with a soft and comfortable writing feeling.

In addition, according to the sixth aspect of the present invention, a knock type writing tool is provided, the knock type writing tool including: a writing body having a pen tip at a front end thereof, a thermochromic ink in an inside thereof, and an air hole at a rear end thereof, the air hole communicating with a space in which the thermochromic ink is contained (a follower may be interposed in the middle); a shaft cylinder configured to contain the writing body in such a manner that the writing body is movable in a front and rear direction with respect to the shaft cylinder; a knock member provided on an outer surface of the shaft cylinder in such a manner that the knock member is movable in a front and rear direction with respect to the shaft cylinder; a projection and retraction rotating member configured to move in a front and rear direction to cause the pen tip to project from or retract within a front end of the shaft cylinder and configured to cause the writing body to rotate, every time the knock member is moved forward; and a cam part provided in the shaft cylinder, the cam part being able to engage or disengage with the projection and retraction rotating member depending on a position of the knock member; wherein a plurality of projection pieces, each of which is projected rearward, are provided at a rear end of the writing body, the plurality of projection pieces being arranged circumferentially apart from each other; a plurality of gaps between the plurality of projection pieces communicate with the air hole; a front portion of the projection and retraction rotating member is provided with a flexible member which is elastically deformable; and the plurality of projection pieces and the flexible member are configured to circumferentially engage with each other when a portion on a rear side of the plurality of projection pieces causes the flexible member to elastically deform and sinks in an inside of the flexible member in such a manner that the writing body rotates in conjunction with a rotation of the projection and retraction rotating member.

According to the above structure, the plurality of gaps between the plurality of projection pieces at a portion thereof that does not sink in the inside of the flexible member can be secured sufficiently. Thus, an appropriate amount of air can be taken in depending on an amount of the thermochromic ink discharged from the pen tip, so that the thermochromic ink can be smoothly discharged from the pen tip.

Advantageous Effects of Invention

According to the first aspect of the present invention, the plurality of gaps between the plurality of projection pieces can be secured sufficiently. Thus, an appropriate amount of air can be taken in depending on an amount of the thermochromic ink discharged from the pen tip, so that the thermochromic ink can be smoothly discharged from the pen tip.

According to the second aspect of the present invention, the plurality of gaps between the plurality of protrusion parts can be secured sufficiently. Thus, an appropriate amount of air can be taken in depending on an amount of the thermochromic ink discharged from the pen tip, so that the thermochromic ink can be smoothly discharged from the pen tip.

According to the third aspect of the present invention, due to the flexible member made of a porous material, air permeability can be secured sufficiently. Thus, an appropriate amount of air can be taken in depending on an amount of the thermochromic ink discharged from the pen tip, so that the thermochromic ink can be smoothly discharged from the pen tip. In addition, the flexible member can absorb an impact and/or a force applied to the writing body at the time of writing, and thus it is possible to provide a user with a soft and comfortable writing feeling.

According to the fourth aspect of the present invention, the connection air hole can be secured sufficiently. Thus, an appropriate amount of air can be taken in depending on an amount of the thermochromic ink discharged from the pen tip, so that the thermochromic ink can be smoothly discharged from the pen tip.

According to the fifth aspect of the present invention, due to the flexible member made of a porous material, air permeability can be secured sufficiently. Thus, an appropriate amount of air can be taken in depending on an amount of the thermochromic ink discharged from the pen tip, so that the thermochromic ink can be smoothly discharged from the pen tip. In addition, the flexible member can absorb an impact and/or a force applied to the writing body at the time of writing, and thus it is possible to provide a user with a soft and comfortable writing feeling.

According to the sixth aspect of the present invention, the plurality of gaps between the plurality of projection pieces at a portion thereof that does not sink in the inside of the flexible member can be secured sufficiently. Thus, an appropriate amount of air can be taken in depending on an amount of the thermochromic ink discharged from the pen tip, so that the thermochromic ink can be smoothly discharged from the pen tip.

DESCRIPTION OF EMBODIMENTS

With reference to the attached drawings, we explain embodiments of the present invention hereinafter.

Structure of First Embodiment

A knock type writing tool according to a first embodiment of the present invention is shown in FIGS. 1 to 20. The knock type writing tool 1 according to the present embodiment includes: a shaft cylinder 2; a writing body 6 contained in the shaft cylinder 2; and a projection and retraction mechanism that causes a pen tip 61 of the writing body 6 to project from and retract within a front end hole 31*a* of the shaft cylinder 2.

(Writing Body)

Figure 3:
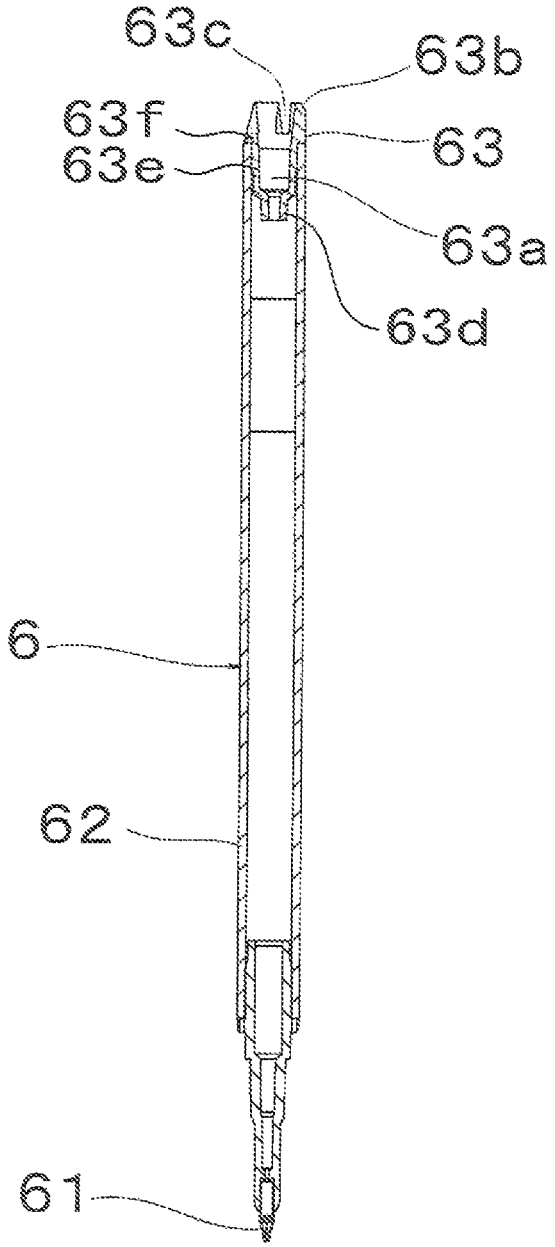
FIG. 3 is a longitudinal section view of a writing body shown in FIG. 1.
Figure 4:
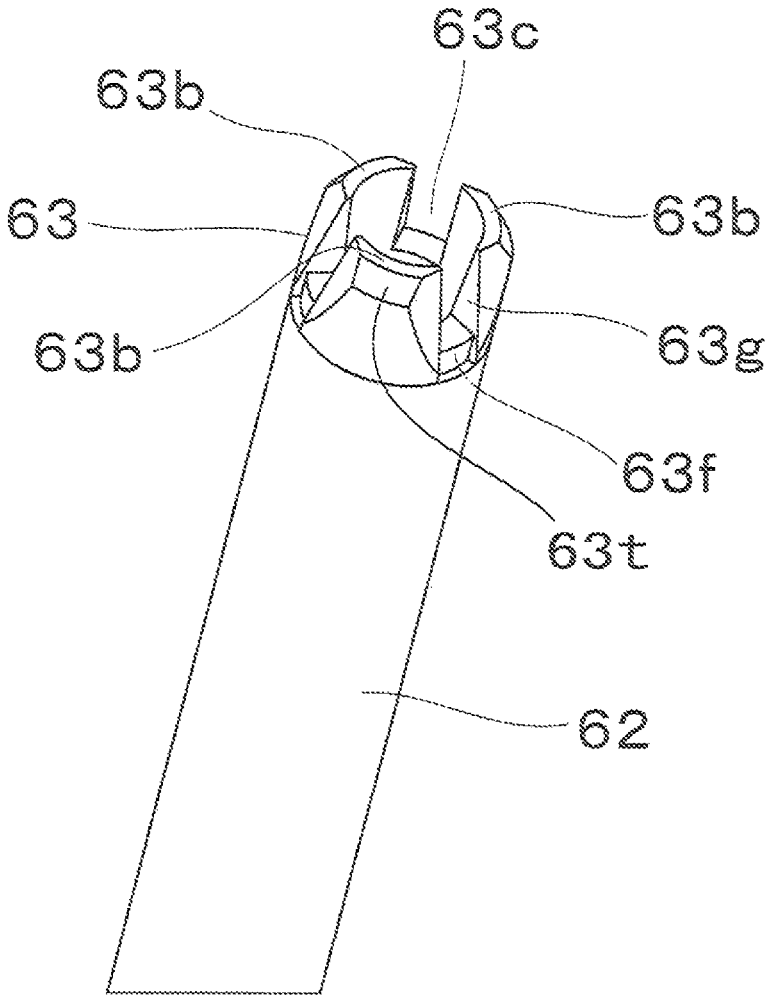
FIG. 4 is a perspective view of a rear end portion of the writing body shown in FIG. 3.
Figure 5:
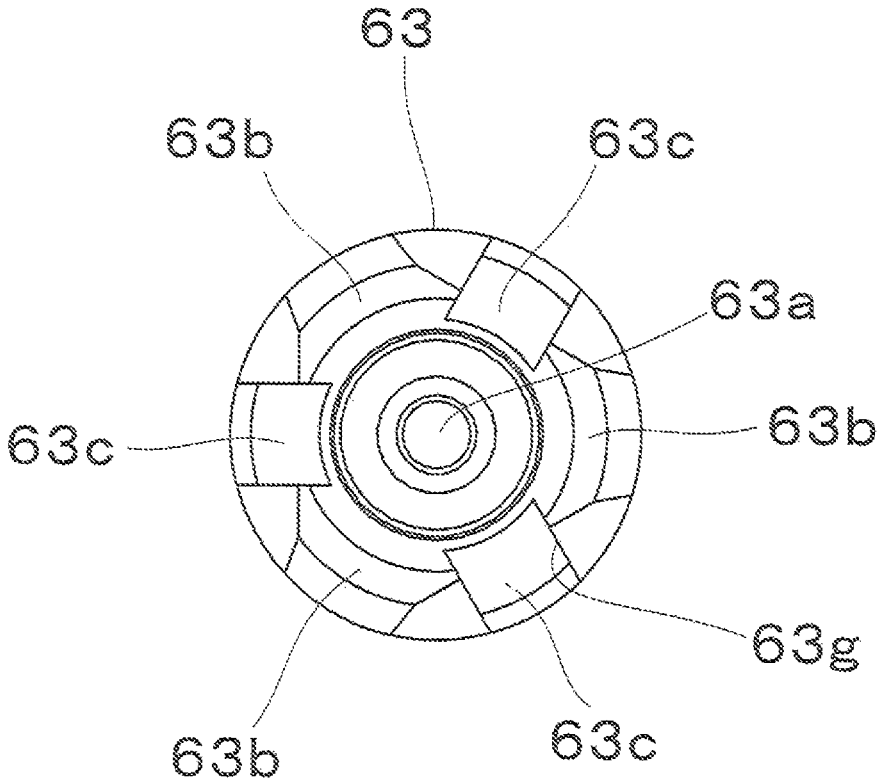
FIG. 5 is a plan view of the rear end portion of the writing body shown in FIG. 3.

The writing body 6 of the present embodiment is shown in FIGS. 3 to 5. With reference to FIG. 3, the writing body 6 includes: the pen tip 61; an ink containing tube 62 having a front end opening into which the pen tip 61 is press-fitted; an thermochromic ink filled in the ink containing tube 62; a follower (for example, high viscosity fluid) filled adjacent to a rear end of the thermochromic ink in such a manner that the follower moves forward as the thermochromic ink is consumed; and a tail plug 63 attached to a rear end opening of the ink containing tube 62. The tail plug 63 is provided with an air hole 63*a* that opens toward a rear end thereof. The air hole 63*a* can communicate the inside of the ink containing tube 62 and the outside thereof.

For example, the pen tip 61 has a structure consisting of only a ball point pen tip made of metal, which holds a ball at a front end thereof in a rotatable manner, or a structure consisting of a combination of such a ball point pen tip and a pen tip holder made of a synthetic resin, which holds a rear outer surface of the ball point pen tip. A spring configured to press forward the ball at the front end is contained in an inside of the pen tip 61. For example, the spring has a structure wherein a rod part is provided at a front end of a compression coil spring and a front end of the rod part contacts with a rear surface of the ball. When the ball is not used for writing, the ball sealingly contacts with an inwardly-facing front-edge inner surface of a front end of the ball point pen tip. Thereby, ink leakage and ink evaporation from the front end of the pen tip 61 is prevented.

In addition, a plurality of projection pieces 63*b* are provided at a rear end of the writing body 6 of the present embodiment, the plurality of projection pieces 63*b* being arranged circumferentially apart from each other.

(Tail Plug)

The tail plug 63 of the present embodiment is a substantially cylindrical member obtained from a molded body made of a synthetic resin (for example, a polypropylene resin). With reference to FIG. 3, the tail plug 63 includes: a smaller diameter part 63*d* located at a front end portion thereof; a larger diameter part 63*e* integrally provided on a rear side of the smaller diameter part 63*d*; a flange part 63*f* integrally provided on a further rear side of the larger diameter part 63*e*; and the plurality of projection pieces 63*b* integrally provided on a further rear side of the flange part 63*f*.

An annular outward protrusion 63*p* (see FIG. 19) is formed on an outer surface of the larger diameter part 63*e* of the tail plug 63. When the tail plug 63 is attached on the ink containing tube 62, the annular outward protrusion 63*p* is annularly press-fitted into an inner surface at a rear end portion of the ink containing tube 62. Then, a front surface of the flange part 63*f* abuts on a rear end of the ink containing tube 62 (see FIG. 19).

An air hole 63*a* is formed through the tail plug 63 in an axial direction (in a front and rear direction). In addition, a plurality of gaps 63*c*, each of which has a cutout pattern, are formed between the respective projection pieces 63*b*, so that the plurality of gaps 63*c* are radially communicated with the air hole 63*a*. Due to the plurality of gaps 63*c* and the air hole 63*a*, air can flow between the inside of the ink containing tube 62 and the outside thereof.

The present invention is not limited to the manner wherein each of the plurality of projection pieces 63*b* is integrally formed on the rear side of the flange part 63*f*. The plurality of projection pieces 63*b* may be formed separately and then joined to the flange part 63*f*.

(Shaft Cylinder)

The shaft cylinder 2 of the present embodiment consists of: a front shaft 3 having a tapered cylindrical shape; an intermediate shaft 4 connected to a rear end portion of the front shaft 3 and having a cylindrical shape; and a rear shaft 5 connected to a rear end portion of the intermediate shaft 4 and having a cylindrical shape.

(Front Shaft)

Figure 7:
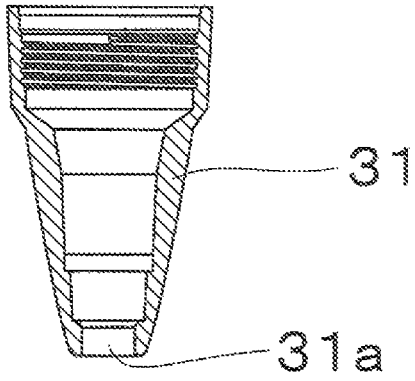
FIG. 7 is a section view taken along line A-A of FIG. 6.
Figure 8:
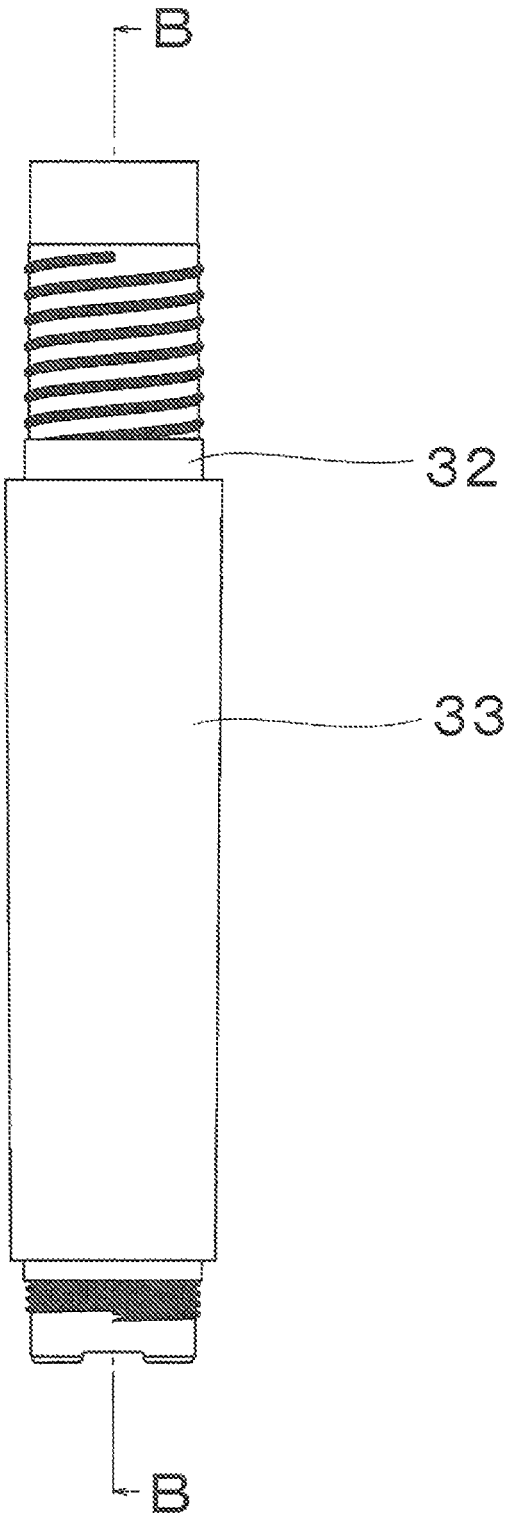
FIG. 8 is a front view of a main body of the front shaft shown in FIG. 1.
Figure 9:
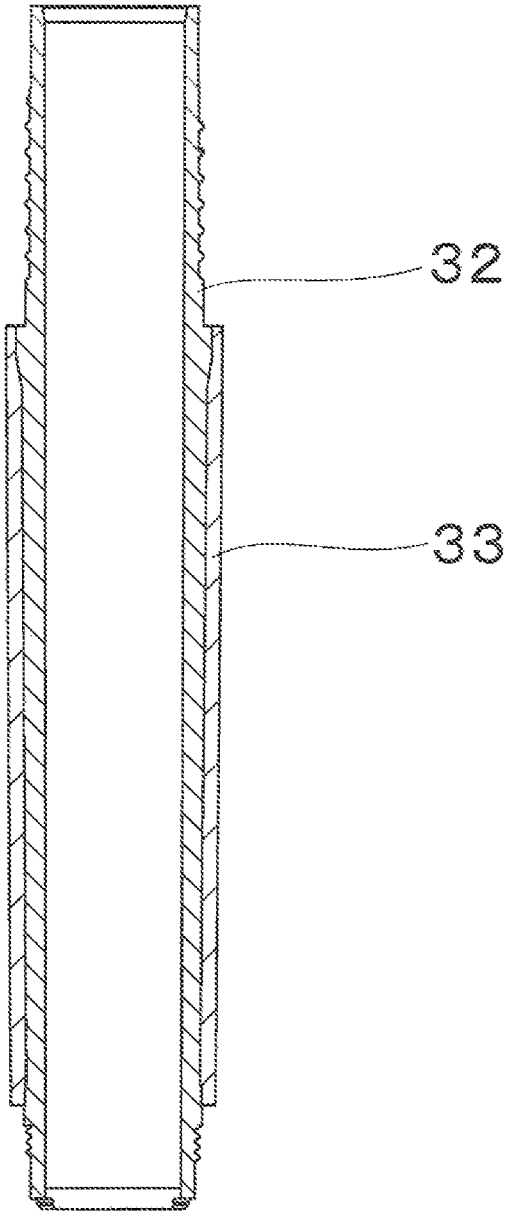
FIG. 9 is a section view taken along line B-B of FIG. 8.

The front shaft 3 of the present embodiment consists of: a tapered ferrule 31 made of a metallic material (see FIGS. 6 and 7); a main body 32 connected to a rear end of the ferrule 31, consisting of a molded body made of a synthetic resin, and having a cylindrical shape (see FIGS. 8 and 9); and a holding part 33 provided on an outer surface of the main body 32 and consisting of an elastic material (see FIGS. 8 and 9).

The ferrule 31 and the main body 32 are threadedly engaged. For example, an internal threaded part is formed on an inner surface of a rear end portion of the ferrule 31, an external threaded part is formed on an outer surface of a front end portion (reduced diameter part) of the main body 32, and the internal threaded part and the external threaded part are detachably threadedly engaged.

The holding part 33 is formed on the outer surface of the main body 32 by a two-color molding, for example, or formed separately and then attached thereon.

With reference to FIG. 9, a rear end portion of the front shaft 3 (a rear and portion of the main body 32) has a reduced diameter, and an external threaded part is formed on an outer surface thereof. The external threaded part is threadedly engaged with an internal threaded part formed on an inner surface of a front end portion of the intermediate shaft 4.

Figure 6:
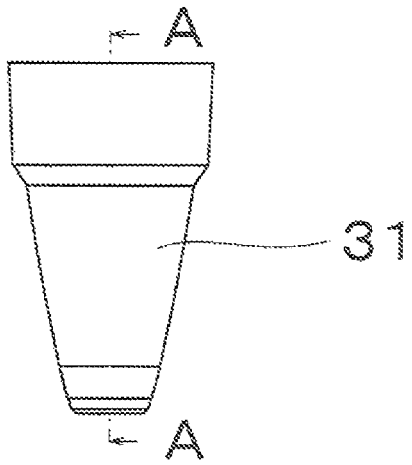
FIG. 6 is a front view of a ferrule of a front shaft shown in FIG. 1.

On the other hand, with reference to FIGS. 6 and 7, a front end hole 31*a* is formed through a front end portion of the front shaft 3 (a front and portion of the ferrule 31) in a front and rear direction.

(Intermediate Shaft)

Figure 10:
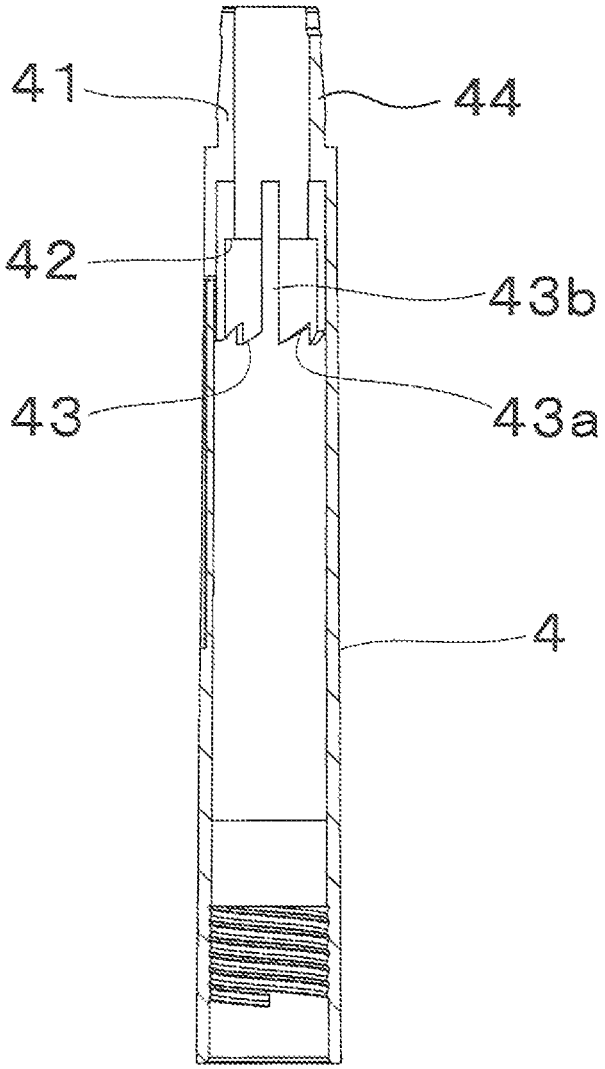
FIG. 10 is a longitudinal section view of an intermediate shaft shown in FIG. 1.

With reference to FIG. 10, the intermediate shaft 4 of the present embodiment consists of a molded body made of a synthetic resin (for example, a polycarbonate resin). The internal threaded part is formed on the inner surface of the front end portion of the intermediate shaft 4, and the internal threaded part can be threadedly engaged with the external threaded part at the rear end portion of the front shaft 3. A rear end portion of the intermediate shaft 4 is integrally provided with a reduced diameter part.

The reduced diameter part is provided with a first elongated hole 41 extending in a front and rear direction. A front end of the first elongated hole 41 is closed by a lateral wall of the intermediate shaft 4. On the other hand, a rear end of the first elongated hole 41 extends to a rear end of the intermediate shaft 4 (i.e., is opened at the rear end of the intermediate shaft 4).

In addition, an outward protrusion 44 is integrally formed on an outer surface of the reduced diameter part. A step part 42 is integrally formed on an inner surface of the intermediate shaft 4 ahead of the reduced diameter part.

A cam part 43 is integrally formed on an inner surface of the intermediate shaft 4 further ahead of the step part 42. The cam part 43 has a plurality of cam teeth 43*a*, each of which has a saw-tooth shape and extends forward, and a plurality of cam grooves 43*b*, each of which is formed between the cam teeth 43*a* and extends in a front and rear direction.

The front end of the first elongated hole 41 is located slightly ahead of the step part 42 (a rear end of the cam part 43) and behind the cam teeth 43*a* of the cam part 43.

(Rear Shaft)

Figure 11:
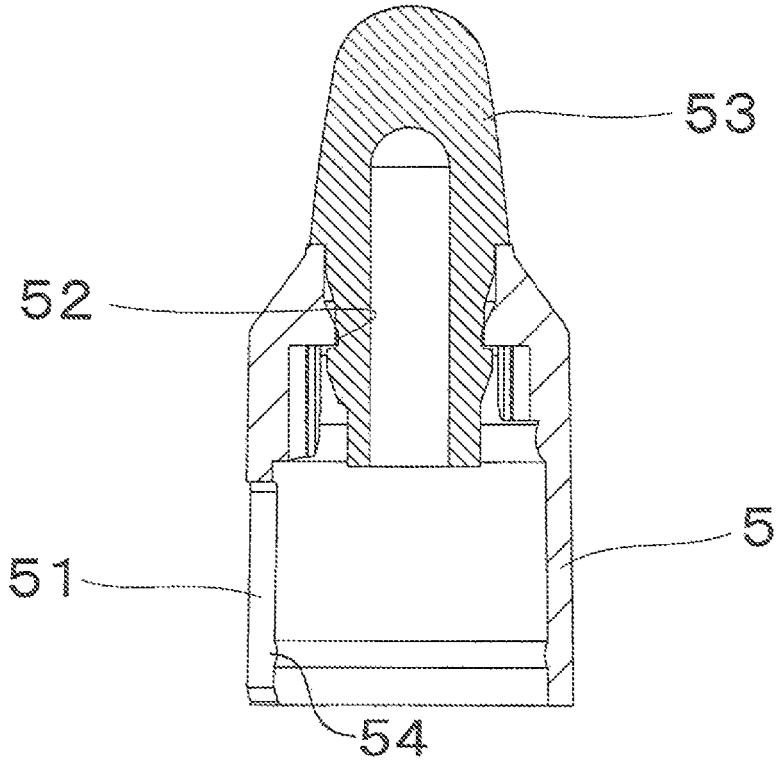
FIG. 11 is a longitudinal section view of a rear shaft shown in FIG. 1.

With reference to FIG. 11, the rear shaft 5 of the present embodiment consists of a substantially cylindrical molded body made of a synthetic resin (for example, a polycarbonate resin). A second elongated hole 51 is formed on a lateral wall of a front end portion of the rear shaft 5. A rear end of the second elongated hole 51 is closed by the lateral wall of the rear shaft 5. On the other hand, a front end of the second elongated hole 51 extends to a front end of the rear shaft 5 (i.e., is opened at the front end of the rear shaft 5).

An attachment hole 52 is formed through a rear end portion of the rear shaft 5 in a front and rear direction. A friction part 53 made of an elastic material is press-fitted into the attachment hole 52. Thereby, the friction part 53 is fixed to an outer surface of the rear end portion of the rear shaft 5. In addition, an inward protrusion 54 is integrally formed on an inner surface of the rear shaft 5.

The elastic material for forming the friction part 53 is preferably an elastic synthetic resin (rubber, elastomer), for example, a silicone resin, an SBS resin (styrene-butadiene-styrene copolymer), a SEBS resin (styrene-ethylene-butylene-styrene copolymer), a fluorine-based resin, a chloroprene resin, a nitrile resin, a polyester resin, an ethylene propylene diene rubber (EPDM), or a mixture of two or more rubber elastic materials, or a mixture of a rubber elastic material and a synthetic resin, or the like.

Preferably, the elastic synthetic resin constituting the friction part 53 is not an easy-to-wear elastic material (for example, an eraser or the like), but a hard-to-wear elastic material which generates almost no wear debris (for example, eraser shavings) when friction occurs. In addition, the friction part 53 may be provided on an outer surface at a rear end portion of the shaft cylinder 2 in various manners. For example, the friction part 53 made of an elastic material may be provided on the outer surface of the rear end portion of the shaft cylinder 2 or on the outer surface of the rear end portion of the rear shaft 5, by a press-fitting, an engagement, a threadedly engagement, a fitting, an adhesion, a two-color molding, or the like. Furthermore, the entire shaft cylinder 2 or the entire rear shaft 5 may be integrally made of an elastic material.

In addition, a width dimension of the second elongated hole 51 is set to be equal to a width dimension of the first elongated hole 41. Thus, as will be described below, a knock member 8 can smoothly move in a front and rear direction along a slide hole 21 (=first elongated hole 41+second elongated hole 51). The friction part 53 does not move when the knock member 8 moves in the front and rear direction.

(Knock Member)

Figure 1:
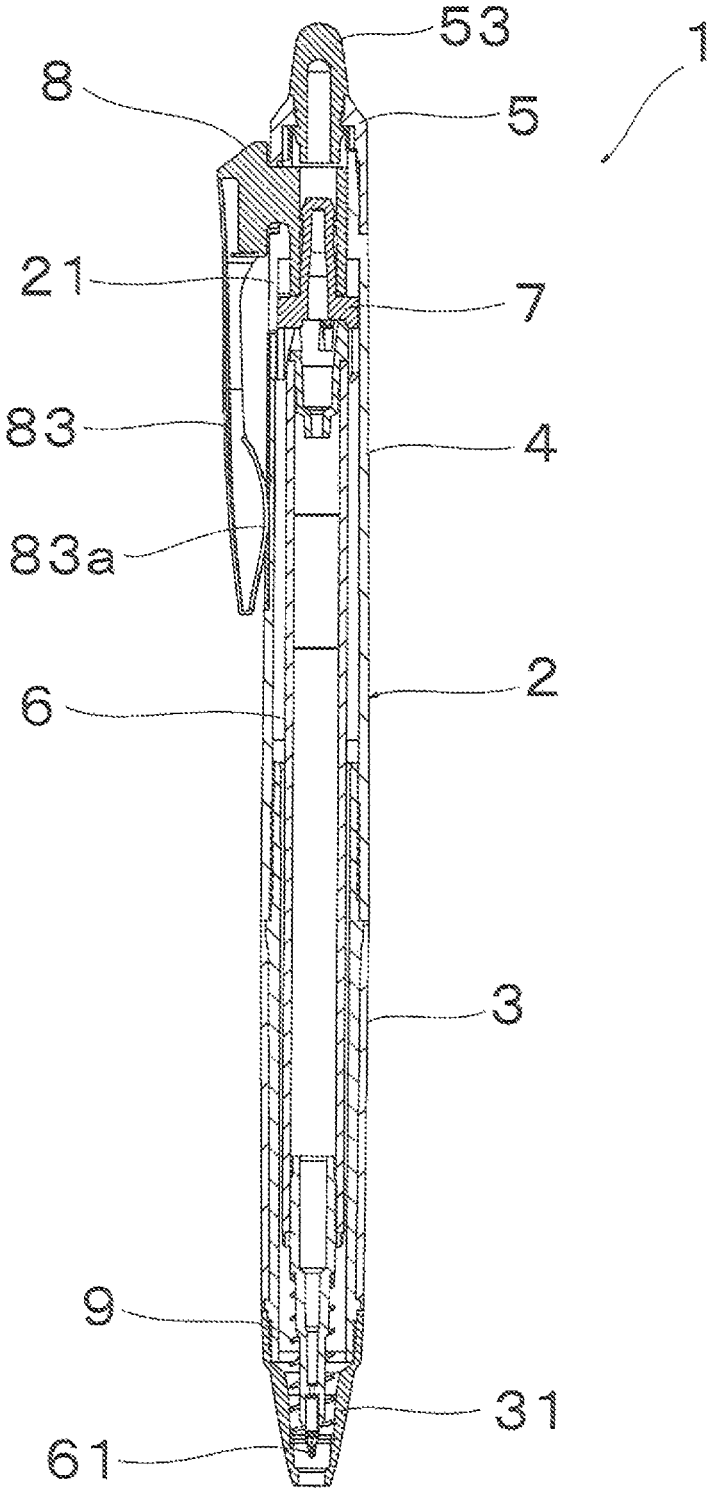
FIG. 1 is a longitudinal section view showing a knock type writing tool according to a first embodiment of the present invention, under a state wherein a pen tip is retracted.
Figure 2:
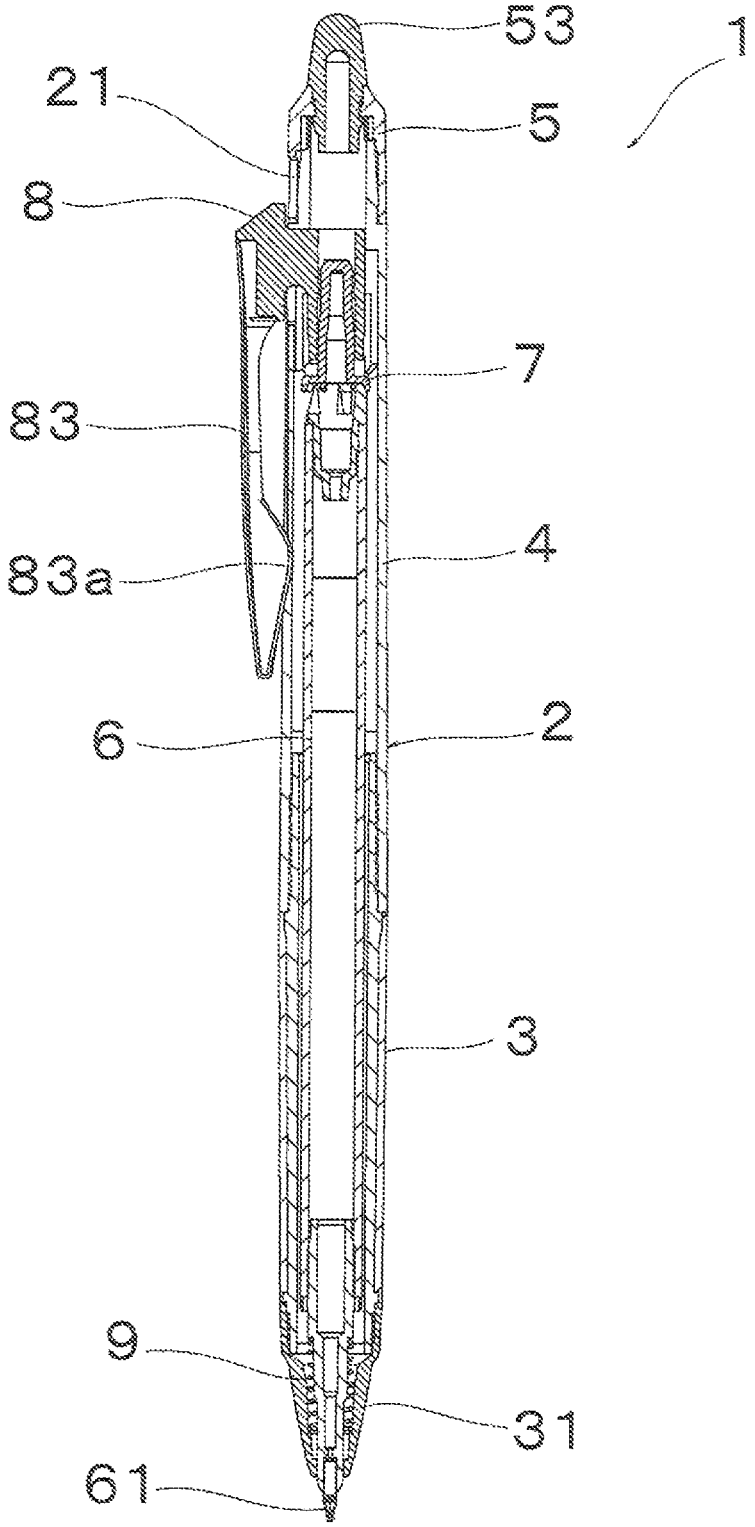
FIG. 2 is a longitudinal section view showing the knock type writing tool according to the first embodiment of the present invention, under a state wherein the pen tip is projected.
Figure 12:
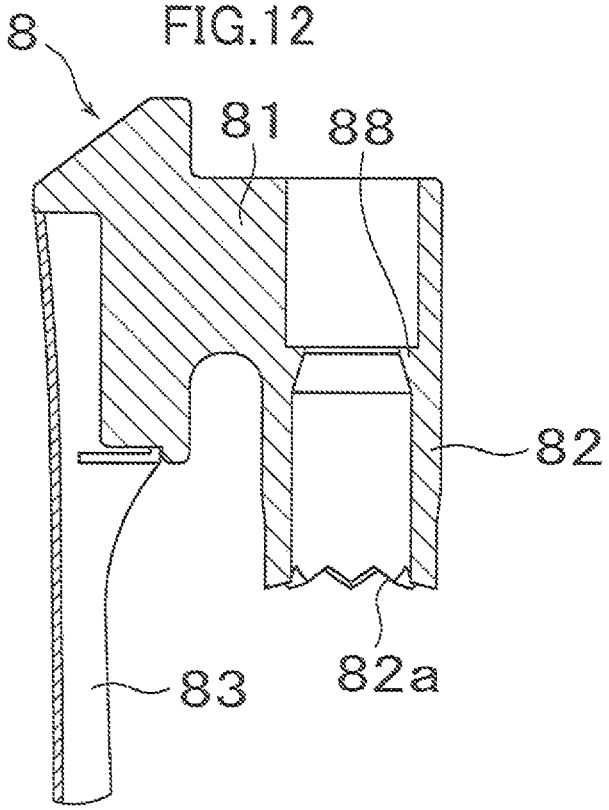
FIG. 12 is a longitudinal section view of a knock member shown in FIG. 1.
Figure 13:
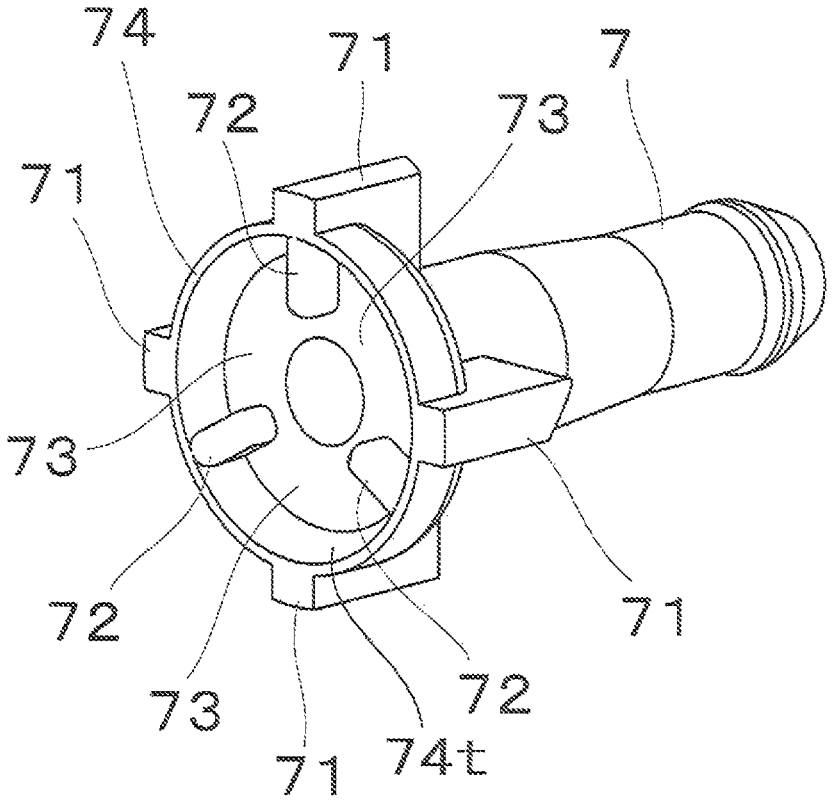
FIG. 13 is a perspective view of a projection and retraction rotating member shown in FIG. 1.
Figure 14:
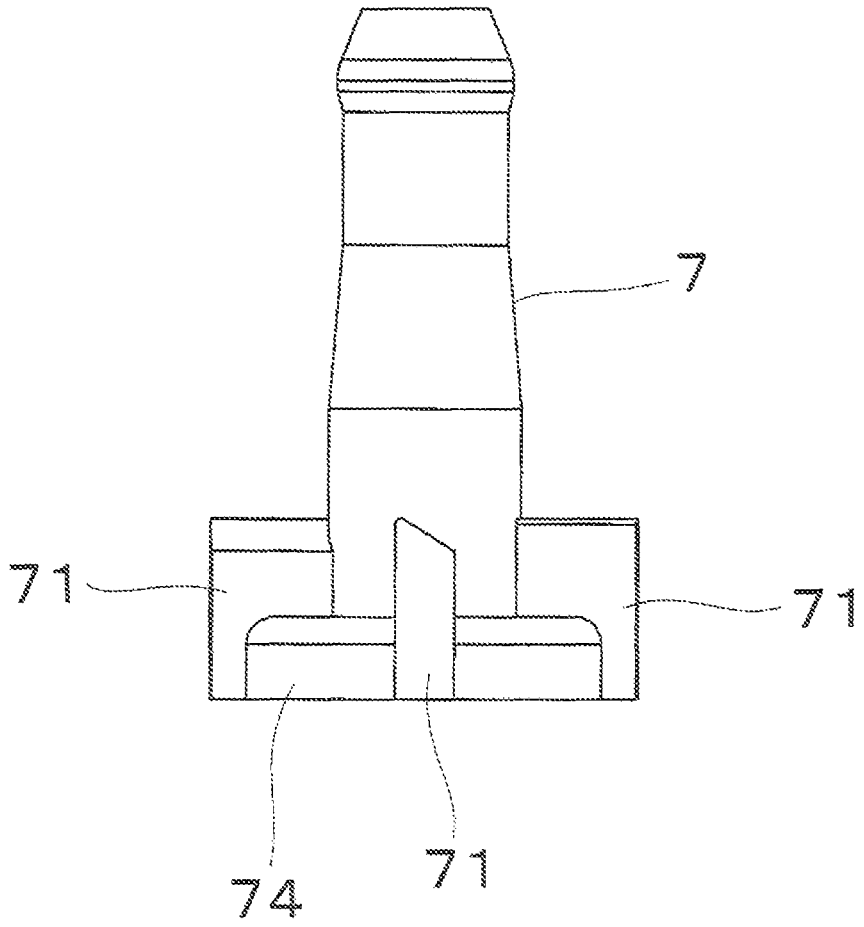
FIG. 14 is a front view of the projection and retraction rotating member shown in FIG. 1.
Figure 15:
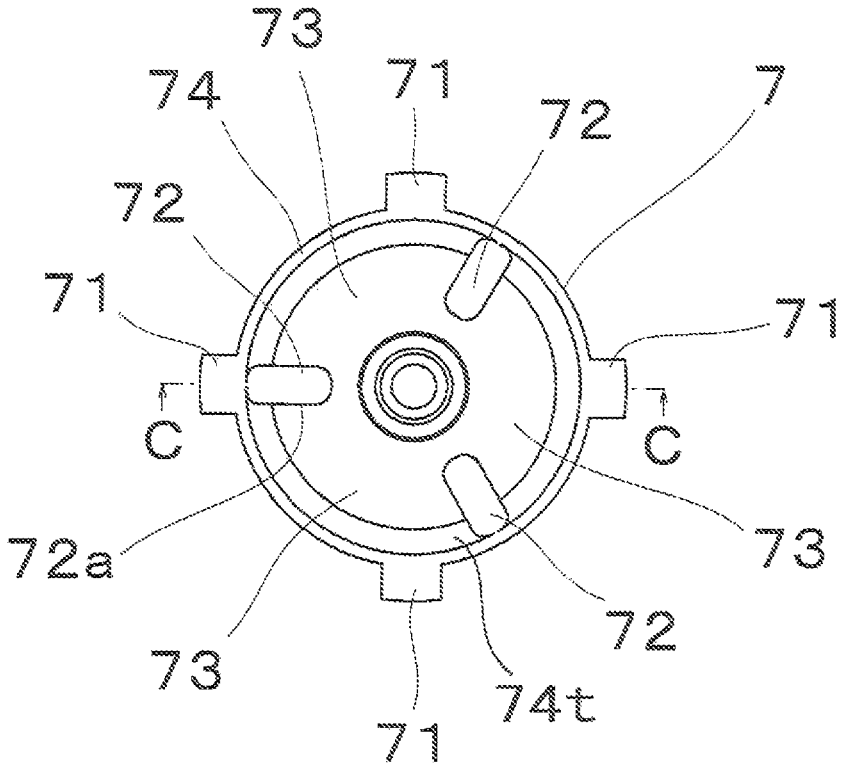
FIG. 15 is a bottom view of the projection and retraction rotating member shown in FIG. 14.
Figure 16:
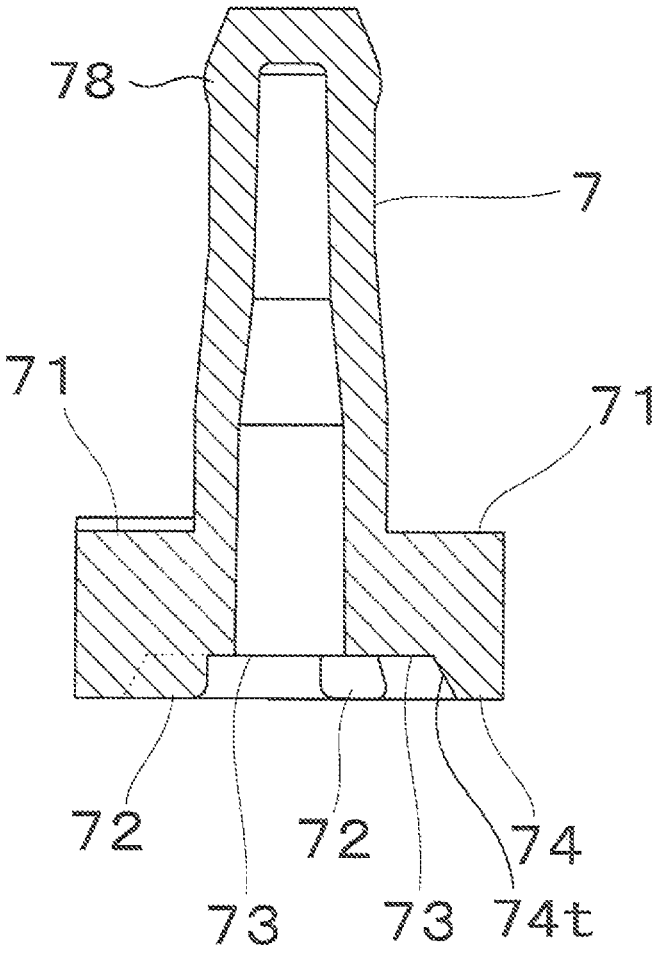
FIG. 16 is a section view taken along line C-C of FIG. 15.

With reference to FIGS. 1, 2 and 12, a clip 83 extending in a front and rear direction is fixed to the knock member 8 of the present embodiment. A ball part 83*a* is projected from a back surface of the clip 83. The knock member 8 consists of: a base part 81 fixed to a rear end portion of the clip 83; and a cylindrical shaft part 82 integrally connected to the base part 81 and extending forward form the base part 81.

For example, the knock member 8 is obtained by a molded body made of a synthetic resin (for example, a polycarbonate resin). For example, the clip 83 is obtained from a metallic material (for example, stainless steel).

As shown in FIG. 12, a plurality of cam teeth 82*a* configured to engage with rear ends of ridges 71 of a projection and retraction rotating member 7 (see FIGS. 13 to 16) are integrally formed at a front end of the shaft part 82.

Herein, how to assemble the knock member 8 is explained. The base part 81 of the knock member 8 is inserted into the first elongated hole 41 of the intermediate shaft 4 from the rear end (opened part) of the first elongated hole 41 while the shaft part 82 of the knock member 8 is inserted into the intermediate shaft 4. Subsequently. In order that the first elongated hole 41 of the intermediate shaft 4 and the second elongated hole 51 of the rear shaft 5 are radially communicated with each other (radially overlapped), while the inner surface of the rear shaft 5 is fitted onto the outer surface of the reduced diameter part of the intermediate shaft 4, the base part 81 of the knock member 8 is inserted into the second elongated hole 51 of the rear shaft 5 from the front end (opened part) of the second elongated hole 51. Thereby, the intermediate shaft 4 and the rear shaft 5 are connected (the outward protrusion 44 of the intermediate shaft 4 and the inward protrusion 54 of the rear shaft 5 are engaged after riding over each other), and the slide hole 21 extending in the front and rear direction is formed by the first elongated hole 41 and the second elongated hole 51, and the knock member 8 is in a state of projecting radially outward from the slide hole 21. The knock member 8 is slidable in the front and rear direction along the slide hole 21.

The rear shaft 5, whose rear end is fixed to the friction part 53, is connected to the rear end portion of the intermediate shaft 4, so that the friction part 53 is always fixed to the rear end of the shaft cylinder 2. In addition, the front shaft 3 and the intermediate shaft 4 are detachably threadedly engaged with each other, so that the writing body 6 is replaceable at any time.

(Projection and Retraction Mechanism)

The projection and retraction mechanism of the present embodiment is a side-slide type projection and retraction mechanism using a rotating cam mechanism, which includes: the knock member 8 as described above; the projection and retraction rotating member 7 configured to move in the front and rear direction to cause the pen tip 61 to project from or retract within the front end hole 31*a* of the shaft cylinder 2 and configured to cause the writing body 6

(and thus pen tip 61) to rotate, every time the knock member 8 is moved forward; the cam part 43 as described above which is provided in the shaft cylinder 2 and is able to engage or disengage with the projection and retraction rotating member 7 depending on a position of the knock member 8; and a spring body 9 (for example, a compression coil spring) provided in the shaft cylinder 2 and configured to bias the writing body 6 rearward.

The projection and retraction mechanism of the present embodiment is a double-knock type projection and retraction mechanism in which the knock member 8 is operated (pressed) to move (slide) forward both for a pen tip projection operation and for a pet tip retraction operation.

(Projection and Retraction Rotating Member)

With reference to FIGS. 13 to 16, the projection and retraction rotating member 7 of the present embodiment includes: a large diameter front part having a plurality of (for example, four) ridges 71 on an outer surface thereof, each of which extends in a front and rear direction; and a small diameter rear part integrally connected behind the front part and having a substantially cylindrical shape with a bottom. Each of the plurality of ridges 71 is able to engage with the cam teeth 43*a* of the cam part 43 and the cam grooves 43*b* of the cam part 43.

For example, the projection and retraction rotating member 7 is obtained by a molded body made of a synthetic resin (for example, a polyacetal resin). In addition, an outward protrusion 78 is formed on an outer surface of a rear portion of the projection and retraction rotating member 7. The outward protrusion 78 is engaged with an inward protrusion 88 on an inner surface of the shaft part 82 of the knock member 8 after riding over each other. Thereby, coming off of the knock member 8 and the projection and retraction rotating member 7 is prevented, while the projection and retraction rotating member 7 can have a "play" (a movable amount) in a front and rear direction with respect to the knock member 8 and the knock member 8 and the projection and retraction rotating member 7 can circumferentially rotate to each other. The "play" in the front and rear direction is set to be a small dimension (a height difference (an axial distance) between tops and bottoms of the cam teeth 82*a*: see FIG. 18) according to which the ridges 71 of the projection and retraction rotating member 7 and the cam teeth 82*a* can be engaged and disengaged with each other.

A plurality of (for example, three) protrusion parts 72, each of which is protruded forward, are integrally formed on a front surface of the projection and retraction rotating member 7. The protrusion parts 72 are arranged radially, i.e., at regular intervals in a circumferential direction.

In addition, an annular auxiliary protrusion part 74 is also integrally formed on the front surface of the projection and retraction rotating member 7. A radially inner surface of the annular auxiliary protrusion part 74 is integrally connected to a radially outer end portion of each of the plurality of protrusion parts 72.

Furthermore, an inside surface of the annular auxiliary protrusion part 74 is a tapered auxiliary abutment surface 74*t*, and a rear end portion of each projecting piece 63*b* is provided with an auxiliary tapered portion 63*t* on which the auxiliary abutment surface 74*t* is to abut (see FIG. 4). According to this structure, each projecting piece 63*b* can be supported more stably by using the tapered auxiliary abutment surface 74*t*. Furthermore, since the auxiliary abutment surface 74*t* and the auxiliary tapered portion 63*t* are tapered, a so-called "centering" effect can be obtained.

A plurality of (for example, three) planar abutment parts (regions) 73 (which are in a plane perpendicular to the front and rear direction) are formed on the front surface of the projection and retraction rotating member 7. Each abutment part 73 is formed (located) radially inner than the annular auxiliary protrusion part 74 and between the plurality of protrusion parts 72. The rear ends of the projection pieces 63*b* of the tail plug 63 are to abut on the abutment parts 73. On the other hand, each of the protrusion parts 72 is inserted into a gap between the projection pieces 63*b* of the tail plug 63. An axial length of the protrusion parts 72 is formed shorter than an axial length of the projection pieces 63*b*. Thereby, a portion of each of the plurality of gaps 63*c* is left in front of each of the plurality of protrusion parts 72, which allows air to be sufficiently taken into the ink containing tube 62 through the air hole 63*a*.

In addition, a top portion (front end portion) of each of the plurality of protrusion parts 72 has a convex curved surface (for example, a ridge surface having a semicircular cross section (a semi-cylindrical surface)). Thereby, even if the top portions of the protrusion parts 72 contact with the rear ends of the projection pieces 63*b* when the writing body 6 is inserted into the shaft cylinder 2, rotation of the writing body 6 is smoothly prompted, so that the protrusion parts 72 are smoothly guided between the projection pieces 63*b*.

In addition, a circumferential width dimension of each protrusion part 72 is set to be smaller than a circumferential width dimension of each gap 63*c* between the projection pieces 63*b* of the tail plug 63. Thereby, other air passages are formed between lateral surfaces of the protrusion parts 72 and lateral surfaces of the projection pieces 63*b*.

Herein, in the present embodiment, the front end of the auxiliary abutment surface 74*t* and the front ends of the protrusion parts 72 are located at substantially the same position in an axial direction. However, the front ends of the protrusion parts 72 may be located more forward than the front end of the auxiliary abutment surface 74*t*.

(Thermochromic Ink)

In the present embodiment, it is preferable that the thermochromic Ink is a reversible thermochromic ink. As the reversible thermochromic ink, there are various types, which includes: a heat-decoloring type that decolorizes by heating from a color-developing state; a color-memory holding type that alternately holds a color-developing state or a decoloring state in a specific temperature range; or a heat-coloring type that colorizes (color-develops) by heating from a decoloring state and returns to the decoloring state by cooling from the color-developing state. These types may be used individually or in combination.

As a coloring material contained in the reversible thermochromic ink, for example, a reversible thermochromic pigment is preferably used, in which a reversible thermochromic composition is encapsulated in a microcapsule, the reversible thermochromic composition including at least the following three essential components: (a) an electron-donating color-developing organic compound; (b) an electron-accepting compound; and (c) a reaction medium that determines an occurrence temperature of a reaction (color reaction) in which the above two components are chemically linked.

Figure 17:
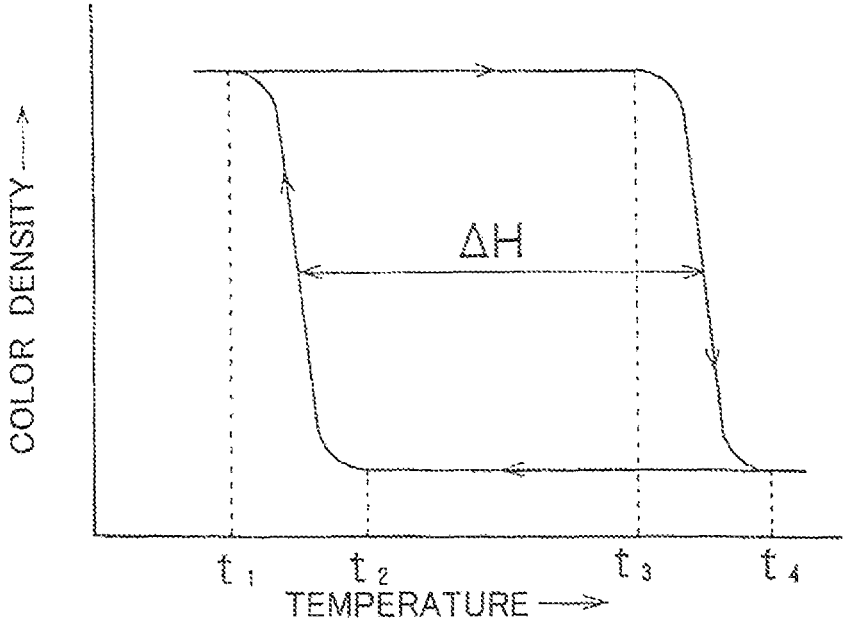
FIG. 17 is an explanatory view showing a color change action of a thermochromic ink.

FIG. 17 is a graph in which a change of color density depending on a change of temperature is plotted in the case of the thermochromic Ink of the present embodiment. As shown in FIG. 17, according to the thermochromic Ink of the present embodiment, the change of color density has different routes between when a temperature thereof is increased from a lower temperature side compared with a color-changing temperature range and when the temperature thereof is decreased from a higher temperature side compared with the color-changing temperature range.

In detail, a color-developing state at a low temperature range below a completely color-developing temperature (t1) or a decoloring state at a high temperature range above a completely decoloring temperature (t4) can be maintained as a memory within a specific temperature range (t2 to t3: which is called a substantially two-phase holding temperature range). An ink having such properties is called a color-memory holding type thermochromic ink.

In addition, in FIG. 17, ΔH indicate a temperature width (a hysteresis width) corresponding to the degree of hysteresis. When a value of ΔH is small, it is difficult to maintain respective states before and after the color change. When the value of ΔH is large, it is easy to maintain respective states before and after the color change.

In the case of the thermochromic Ink of the present embodiment, it is assumed that the color change is caused by a friction heat of the friction part 53. Thus, the completely decoloring temperature (color-changing point on higher temperature side: t4) is set within a range of 25° C. to 95° C. (preferably, 36° C. to 90° C.), and the completely color-developing temperature (color-changing point on lower temperature side: t1) is set within a range of −30° C. to +20° C. (preferably, −30° C. to +10° C.). Thereby, the color-developing state in a normal condition (within a daily living temperature range) can be effectively maintained. Thus, a written trace of the reversible thermochromic Ink can be easily caused to decolorize by the friction heat generated by the friction part 53.

Operation of First Embodiment: Projection and Retraction of Pen Tip

Figure 18:
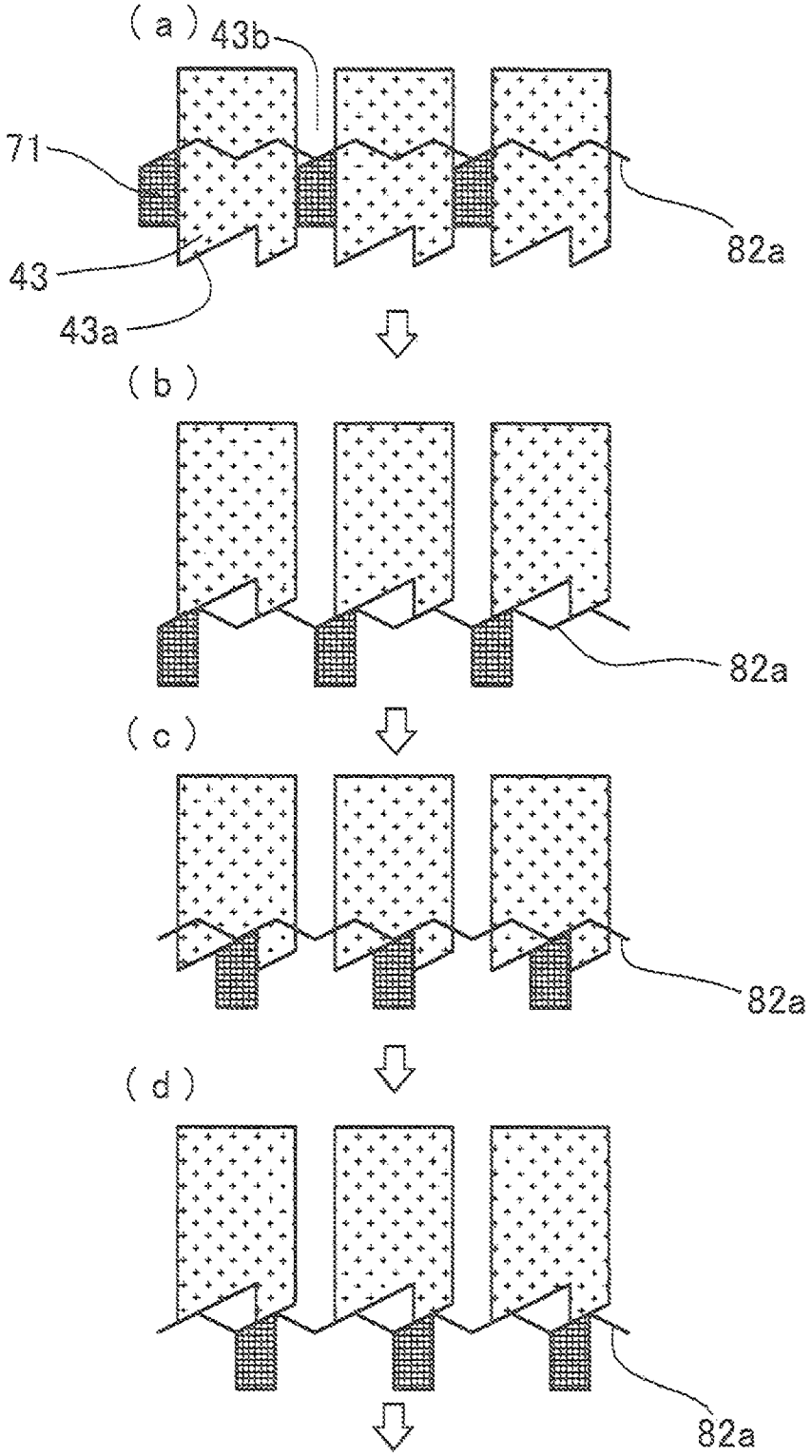
FIG. 18 is a schematic view for explaining a principle of a rotating cam mechanism.

FIG. 18 is a schematic view for explaining a principle of the rotating cam mechanism. With reference to FIG. 18, from a pen tip retraction state (see FIG. 18(*a*)), when the knock member 8 is operated (pressed) to move (slide) forward against a rearward biasing force of the spring body 9, the ridges 71 of the projection and retraction rotating member 7, which have been engaged with the cam teeth 82*a* at the front end of the shaft part 82 of the knock member 8, are pressed forward by the cam teeth 82*a*. The ridges 71 of the projection and retraction rotating member 7 are moved forward along the cam grooves 43*b*.

When the ridges 71 of the projection and retraction rotating member 7 are moved forward, the projection and retraction rotating member 7 presses the writing body 6 forward according to abutment relationship between the abutment parts 73 and the projection pieces 63*b* of the tail plug 63. Then, the pen tip 61 is projected outward from the front end hole 31*a*.

At the deepest position of the knocking operation of the knock member 8, the rear ends of the ridges 71 get out of the cam grooves 43*b*, and move (fall) into the bottoms of the cam teeth 82*a* of the knock member 8. Thereby, the projection and retraction rotating member 7 slightly rotates circumferentially (see FIG. 18(*b*)).

Subsequently, when the knock member 8 is returned to an original position thereof by the rearward biasing force of the spring body 9, the rear ends of the ridges 71 move (fall) into bottoms of the cam teeth 43*a* of the cam part 43. Thereby, the projection and retraction rotating member 7 further rotates circumferentially (see FIG. 18(*c*)). In addition, the rear ends of the ridges 71 stay in the bottoms of the cam teeth 43*a* of the cam part 43, so that a pen tip projection state is maintained.

Next, from the pen tip projection state (see FIG. 18(*c*)), when the knock member 8 is operated (pressed) to move (slide) forward, the ridges 71 of the projection and retraction rotating member 7 are again engaged with the cam teeth 82*a* at the front end of the shaft part 82 of the knock member 8, and are pressed forward by the cam teeth 82*a*.

At the deepest position of the knocking operation of the knock member 8, the rear ends of the ridges 71 ride over tops (teeth) of the cam teeth 43*a* of the cam part 43, and move (fall) into the bottoms of the cam teeth 82*a* of the knock member 8. Thereby, the projection and retraction rotating member 7 slightly rotates circumferentially (see FIG. 18(*d*)). Subsequently, when the knock member 8 is returned to the original position thereof by the rearward biasing force of the spring body 9, the ridges 71 are guided into the cam grooves 43*a*, so that the pen tip retraction state is maintained (see FIG. 18(*a*)).

Operation of First Embodiment: Rotation of Pen Tip

Figure 19:
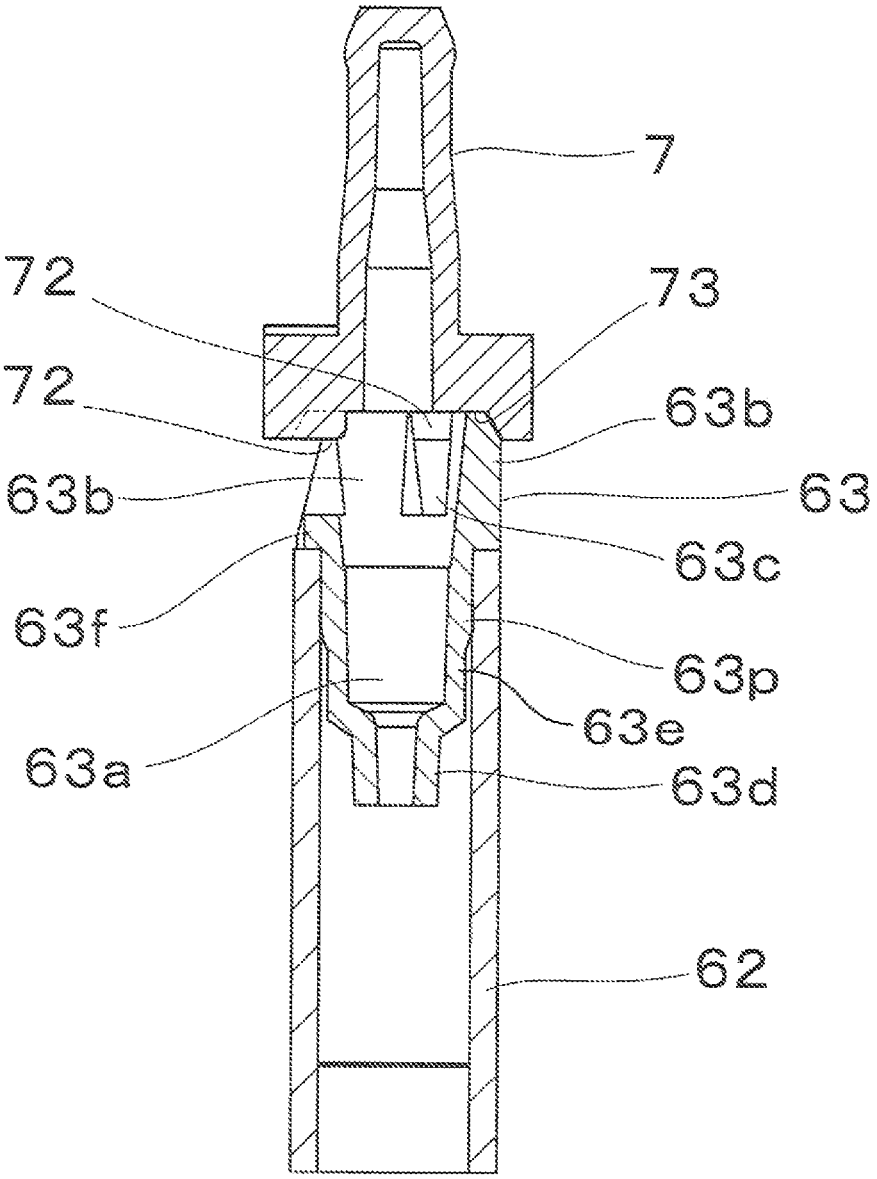
FIG. 19 is a longitudinal section view showing an abutment state between the projection and retraction rotating member and the rear end of the writing body.
Figure 20:
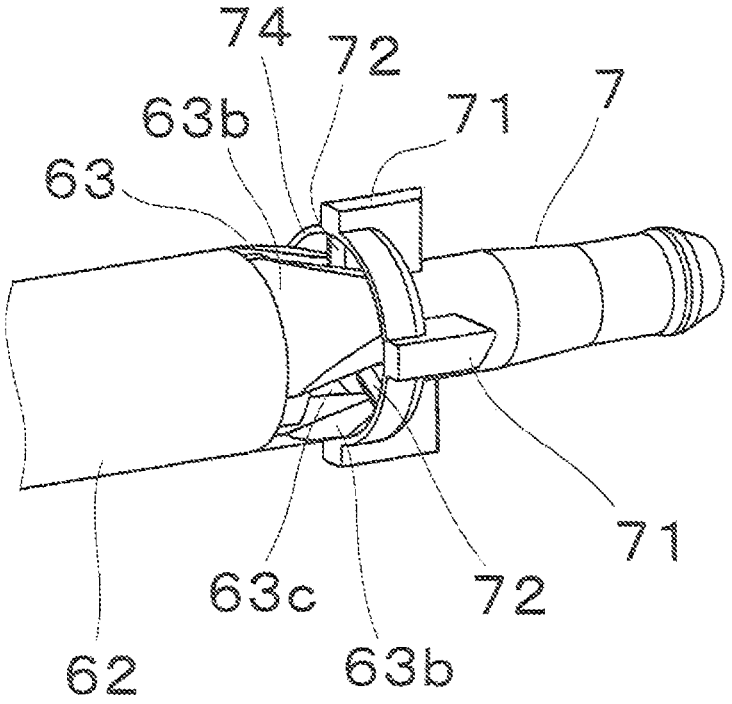
FIG. 20 is a perspective view showing the abutment state between the projection and retraction rotating member and the rear end of the writing body.

The abutment state between the projection pieces 63*b* of the tail plug 63 and the abutment parts 73 of the projection and retraction rotating member 7 is shown in FIGS. 19 and 20.

The abutment parts 73 on the front surface of the projection and retraction rotating member 7 abut on the projection pieces 63*b* of the tail plug 63 at the rear end of the writing body 6, while the plurality of protrusion parts 72 on the front surface of the projection and retraction rotating member 7 are inserted into the plurality of gaps 63*c* between the projection pieces 63*b* of the tail plug 63 at the rear end of the writing body 6 so that the protrusion parts 72 are circumferentially engaged with the projection pieces 63*b*. Thereby, when the projection and retraction rotating member 7 rotates circumferentially, the writing body 6 also rotates circumferentially.

Herein, both engagement surfaces 63*g* of the projection pieces 63*b* of the tail plug 63 (the lateral surfaces of the projection pieces 63*b* in the circumferential direction) and engagement surfaces 72*a* of the protrusion parts 72 of the projection and retraction rotating member 7 (the lateral surfaces of the protrusion parts 72 in the circumferential direction) extend substantially in parallel to the front and rear direction (axial direction). Thus, the circumferential engagement of the projection and retraction rotating member 7 with the writing body 6 can be obtained more surely.

The circumferential width dimension of each gap 63*c* between the projection pieces 63*b* is set to be larger than the circumferential width dimension of each protrusion part 72. For example, the circumferential width dimension of each gap 63*c* between the projection pieces 63*b* may be set to be 1.5 mm, and the circumferential width dimension of each protrusion part 72 is set to be 0.7 mm.

In addition, a protrusion length of the protrusion parts 72 in the axial direction (an axial length of the protrusion parts 72 protruding forward from the abutment parts 73) is preferably not less than 0.5 mm and not greater than 2.5 mm. In addition, a projection length of the projection pieces 63*b* in the axial direction (an axial length from the rear ends (distal ends) of the projection pieces 63*b* to the proximal ends of the projection pieces 63*b*) is preferably not less than 2 mm and not greater than 5 mm. When these conditions are satisfied, the protrusion parts 72 and the projection pieces 63*b* can be engaged more surely.

Operation of First Embodiment: Appropriate Taking of Air

On the other hand, it is preferable that the difference between the projection length of the projection pieces 63*b* in the axial direction and the protrusion length of the protrusion parts 72 in the axial direction is not less than 1 mm. In this case, a portion of each of the plurality of gaps 63*c* is left in front of each of the plurality of protrusion parts 72, which allows air to be sufficiently taken into the ink containing tube 62 through the air hole 63*a*. Thus, an appropriate amount of air can be taken in depending on an amount of the thermochromic ink discharged from the pen tip 61, so that the thermochromic ink can be smoothly discharged from the pen tip 61.

Effects of First Embodiment

The knock type writing tool 1 of the present embodiment as described above includes: the writing body 6 having the pen tip 61 at the front end thereof, the thermochromic ink in the inside thereof, and the air hole 63*a* at the rear end thereof, the air hole 63*a* communicating with the space in which the thermochromic ink is contained; the shaft cylinder 2 configured to contain the writing body 6 in such a manner that the writing body 6 is movable in the front and rear direction with respect to the shaft cylinder 2; the knock member 8 provided on the outer surface of the shaft cylinder 2 in such a manner that the knock member 8 is movable in the front and rear direction with respect to the shaft cylinder 2; the projection and retraction rotating member 7 configured to move in the front and rear direction to cause the pen tip 61 to project from or retract within the front end of the shaft cylinder 2 and configured to cause the writing body 6 to rotate, every time the knock member 8 is moved forward; and the cam part 43 provided in the shaft cylinder 2, the cam part 43 being able to engage or disengage with the projection and retraction rotating member 7 depending on the position of the knock member 8; wherein the plurality of projection pieces 63*b*, each of which is projected rearward, are provided at the rear end of the writing body 6, the plurality of projection pieces 63*b* being arranged circumferentially apart from each other; the plurality of gaps 63*c* between the plurality of projection pieces 63*b* communicate with the air hole 63*a*; the front portion of the projection and retraction rotating member 7 is provided with the plurality of abutment parts 73, on which the respective rear ends of the plurality of projection pieces 63*b* are to abut, and the plurality of protrusion parts 72, each of which is protruded more forward than the plurality of abutment parts 73; the plurality of protrusion parts 72 are respectively inserted in the plurality of gaps 63*c* between the plurality of projection pieces 63*b*; and a portion of each of the plurality of gaps 63*c* is left in front of each of the plurality of protrusion parts 72*b*.

According to this feature, the plurality of gaps 63*c* between the plurality of projection pieces 63*b* can be secured sufficiently. Thus, an appropriate amount of air can be taken in depending on an amount of the thermochromic ink discharged from the pen tip 61, so that the thermochromic ink can be smoothly discharged from the pen tip 61.

In addition, according to the knock type writing tool 1 of the present embodiment, the shaft cylinder 2 is configured to contain the writing body 6 in such a manner that the writing body 6 is movable in the front and rear direction with respect to the shaft cylinder 2 under a state in which the writing body 6 is biased rearward; the projection and retraction rotating member 7 is configured to move in the front and rear direction, in conjunction with the movement of the knock member 8 in the front and rear direction; and the projection and retraction rotating member 7 is configured to move forward together with the knock member 8 and to cause the pen tip 61 to project from or retract within the front end of the shaft cylinder 2, every time the knock member 8 is moved forward.

According to this feature, the knock member 8 is also affected by a force for biasing the writing body 6 rearward. Thus, the knock member 8 can be automatically returned, which can provide a good operation feeling and a good operability.

In addition, according to the knock type writing tool 1 of the present embodiment, the plurality of projection pieces 63*b* and the plurality of protrusion parts 72 are configured to circumferentially engage with each other in such a manner that the writing body 6 rotates in conjunction with the rotation of the projection and retraction rotating member 7.

According to this feature, although the structure is simple, the circumferential engagement of the projection and retraction rotating member 7 with the writing body 6 can be surely obtained.

In addition, according to the knock type writing tool 1 of the present embodiment, the engagement surfaces 63*g* of the plurality of projection pieces 63*b* against the plurality of protrusion parts 72 and the engagement surfaces 72*a* of the plurality of protrusion parts 72 against the plurality of projection pieces 63*b* extend substantially in parallel in the front and rear direction.

According to this feature, the respective engagement surfaces are engaged more efficiently, so that the circumferential engagement of the projection and retraction rotating member 7 with the writing body 6 can be obtained more surely.

In addition, according to the knock type writing tool 1 of the present embodiment, the front portion of the projection and retraction rotating member 7 is connected to the annular auxiliary protrusion part 74 provided integrally with the plurality of protrusion parts 72.

According to this feature, the plurality of protrusion parts 72 are effectively reinforced, which can prevent breakage of the plurality of protrusion parts 72 or the like.

In addition, according to the knock type writing tool 1 of the present embodiment, the inside surface of the annular auxiliary protrusion part 74 is the tapered auxiliary abutment surface 74*t*, and the rear end portion of the writing body 6 (the rear end portion of each projection piece 63*b*) is provided with the auxiliary tapered portion 63*t* on which the auxiliary abutment surface 74*t* is to abut.

According to this feature, the rear end portion of the writing body 6 can be supported more stably by using the tapered auxiliary abutment surface 74*t*. Furthermore, since the auxiliary abutment surface 74*t* and the auxiliary tapered portion 63*t* are tapered, a so-called "centering" effect can be obtained.

In addition, according to the knock type writing tool 1 of the present embodiment, the plurality of projection pieces 63*b* are formed of polypropylene resin or polyethylene resin.

According to this feature, the plurality of projection pieces 63*b* can have sufficient strength, so that bending or buckling thereof can be effectively prevented. Thus, a stable rotation of the writing body 6 can be obtained in conjunction with the rotation of the projection and retraction rotating member 7.

As a variation of the present embodiment, the knock member 8 may be configured in such a manner that the knock member 8 is projected rearward from the rear end of the shaft cylinder 2.

Variant of First Embodiment

In the first embodiment, the projection length of the projection pieces 63*b* in the axial direction is longer than the protrusion length of the protrusion parts 72 in the axial direction. However, the protrusion length of the protrusion parts 72 in the axial direction may be longer than the projection length of the projection pieces 63*b* in the axial direction. In the latter case, a gap 72*c* is left behind each of the projection pieces 63*b*, which ensures that air is sufficiently taken into the ink containing tube 62 through the air hole 63*a*.

Figure 21:
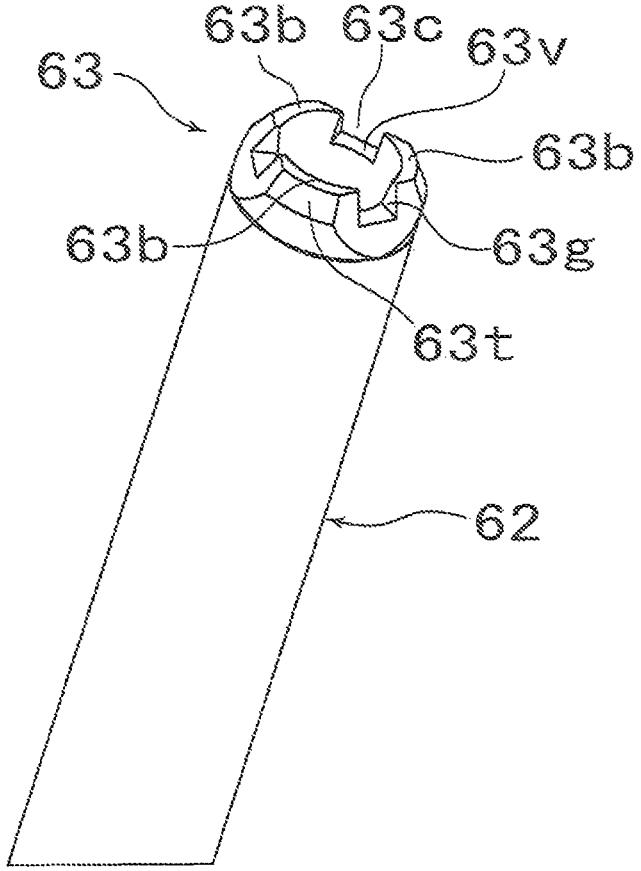
FIG. 21 is a view corresponding to FIG. 4 with regard to a variant of the first embodiment of the present invention.
Figure 22:
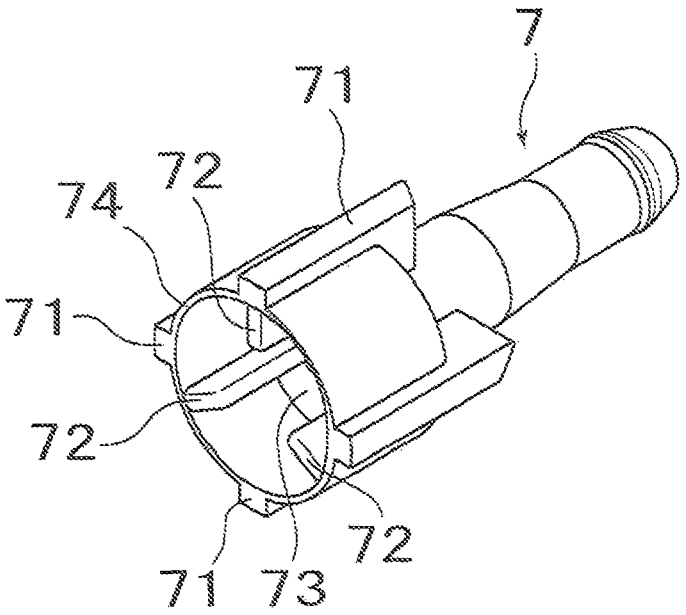
FIG. 22 is a view corresponding to FIG. 13 with regard to the variant of the first embodiment of the present invention.
Figure 23:
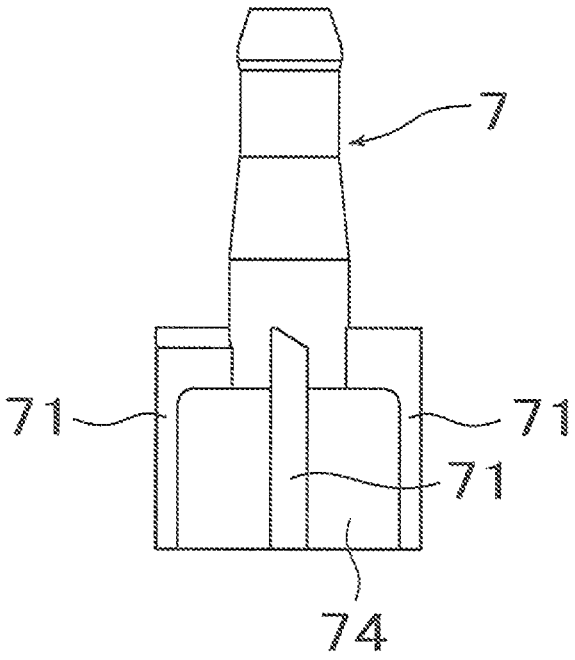
FIG. 23 is a view corresponding to FIG. 14 with regard to the variant of the first embodiment of the present invention.
Figure 24:
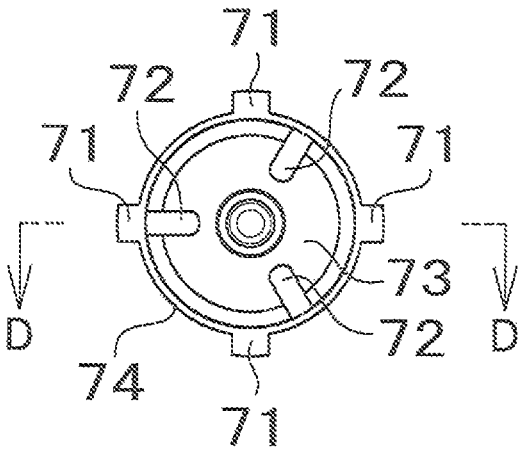
FIG. 24 is a view corresponding to FIG. 15 with regard to the variant of the first embodiment of the present invention.
Figure 25:
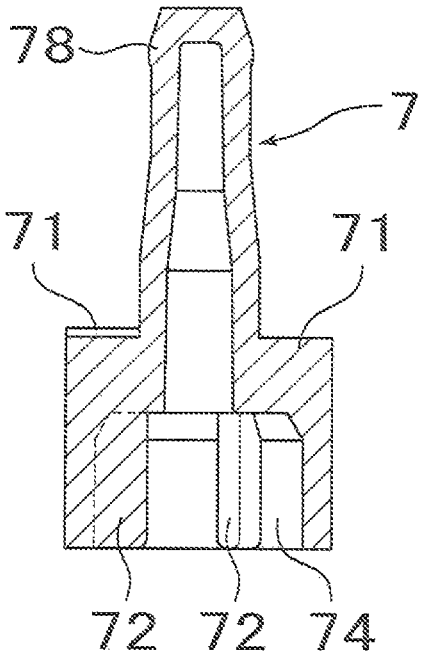
FIG. 25 is a section view taken along line D-D of FIG. 24 (a view corresponding to FIG. 16 with regard to the variant of the first embodiment of the present invention)
Figure 26:
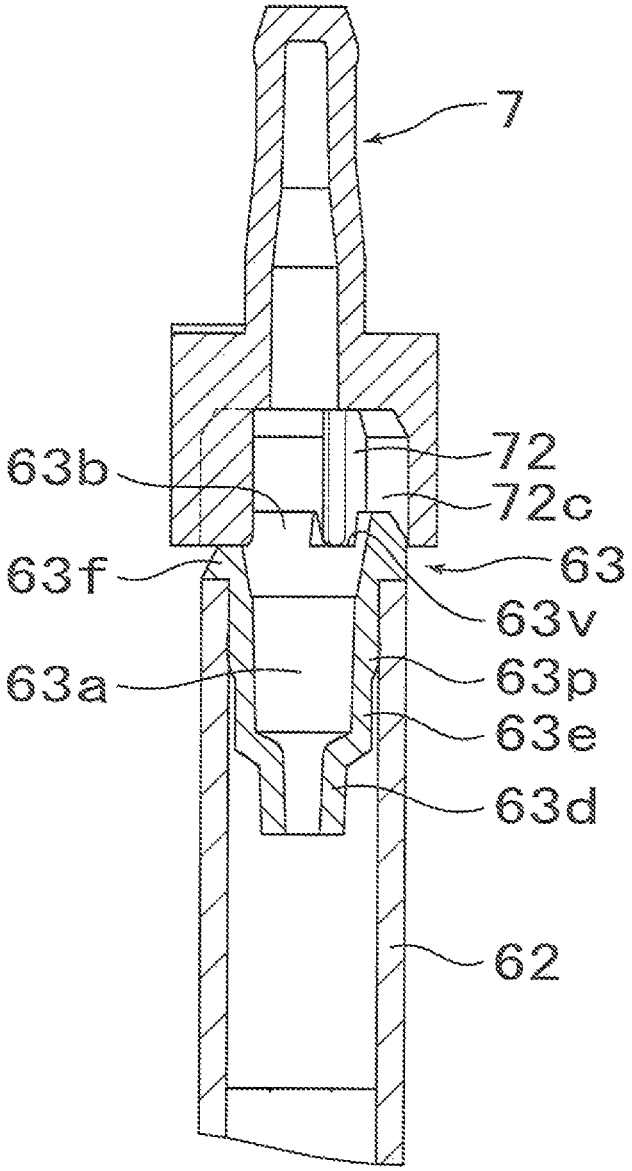
FIG. 26 is a view corresponding to FIG. 19 with regard to the variant of the first embodiment of the present invention.
Figure 27:
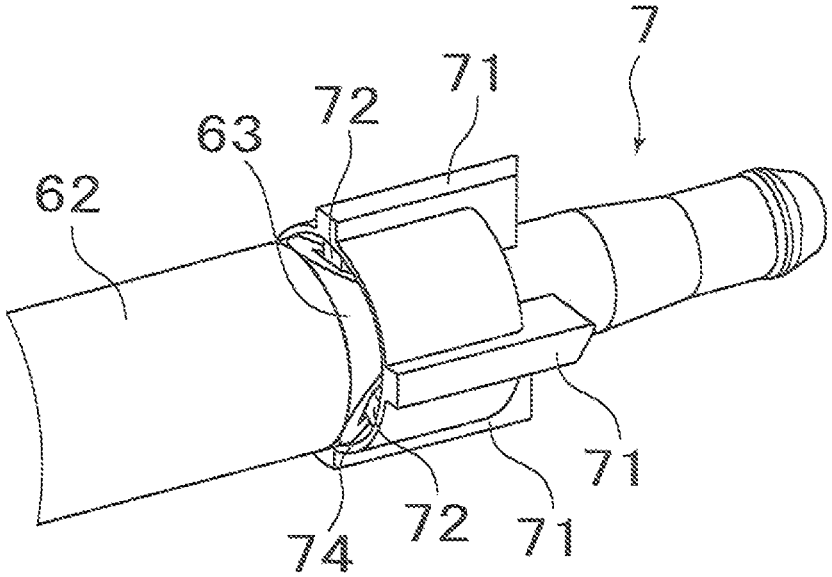
FIG. 27 is a view corresponding to FIG. 20 with regard to the variant of the first embodiment of the present invention.

Such a variant is shown in FIGS. 21 to 27. FIG. 21 is a view corresponding to FIG. 4 with regard to the variant. FIGS. 22 to 25 are views corresponding to FIGS. 13 to 16 with regard to the variant. FIGS. 26 and 27 are views corresponding to FIGS. 19 and 20 with regard to the variant.

As shown in FIGS. 21 to 27, in the same way as the knock type writing tool 1 of the first embodiment, the knock type writing tool of the present variation also includes: the writing body 6 having the pen tip 61 at the front end thereof, the thermochromic ink in the inside thereof, and the air hole 63*a* at the rear end thereof, the air hole 63*a* communicating with the space in which the thermochromic ink is contained; the shaft cylinder 2 configured to contain the writing body 6 in such a manner that the writing body 6 is movable in the front and rear direction with respect to the shaft cylinder 2; the knock member 8 provided on the outer surface of the shaft cylinder 2 in such a manner that the knock member 8 is movable in the front and rear direction with respect to the shaft cylinder 2; the projection and retraction rotating member 7 configured to move in the front and rear direction to cause the pen tip 61 to project from or retract within the front end of the shaft cylinder 2 and configured to cause the writing body 6 to rotate, every time the knock member 8 is moved forward; and the cam part 43 provided in the shaft cylinder 2, the cam part 43 being able to engage or disengage with the projection and retraction rotating member 7 depending on the position of the knock member 8; wherein the plurality of protrusion parts 72, each of which is protruded forward, are provided at the front portion of the projection and retraction rotating member 7, the plurality of protrusion parts 72 being arranged circumferentially apart from each other.

On the other hand, in the present variant, the rear end of the writing body 6 is provided with a plurality of abutment parts 63*v*, on which respective front ends of the plurality of protrusion parts 72 are to abut, and the plurality of projection pieces 63*b*, each of which is projected more rearward than the plurality of abutment parts 63*v*. In addition, the plurality of projection pieces 63*b* are respectively inserted in the plurality of gaps 72*c* between the plurality of protrusion parts 72, and a portion of each of the plurality of gaps 72*c* is left behind each of the plurality of projection pieces 63*b*.

The other structure of the present variant is substantially the same as that of the first embodiment explained with reference to FIGS. 1 to 20. In FIGS. 21 to 27, the same parts as those of the first embodiment are shown by the same reference numerals, and detailed explanation thereof is omitted.

According to the present variant, the plurality of gaps 72*c* between the plurality of protrusion parts 72 can be secured sufficiently. Thus, an appropriate amount of air can be taken in depending on an amount of the thermochromic ink discharged from the pen tip, so that the thermochromic ink can be smoothly discharged from the pen tip.

In the variant as well, it is preferable that the difference between the projection length of the projection pieces 63*b* in the axial direction and the protrusion length of the protrusion parts 72 in the axial direction is not less than 1 mm.

Structure of Second Embodiment

Figure 28:
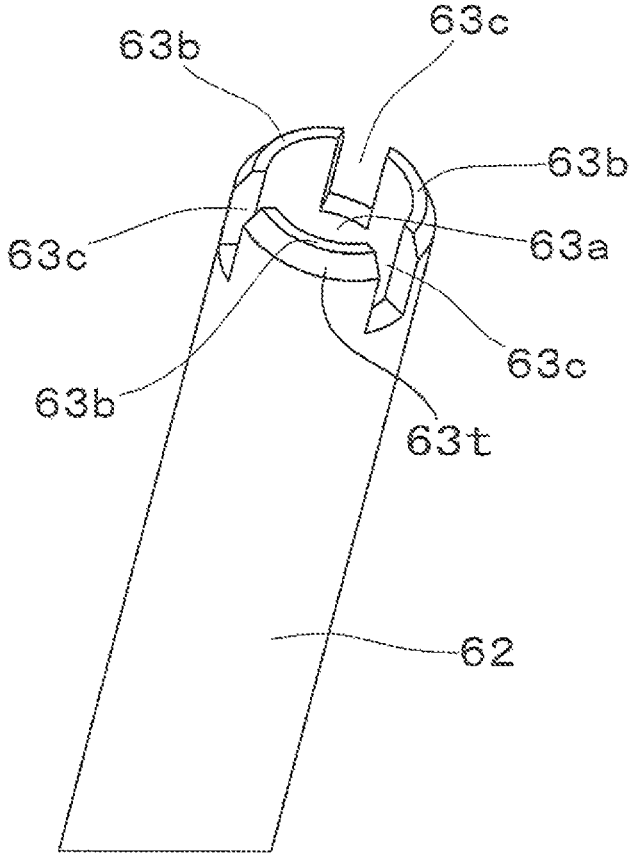
FIG. 28 is a perspective view of a rear end portion of a writing body according to the second embodiment of the present invention.

Subsequently, FIG. 28 is a perspective view of a rear end portion of a writing body 6 according to the second embodiment of the present invention.

As shown in FIG. 28, the writing body of the present embodiment does not have a tail plug, and a plurality of projection pieces 63*b* are integrally formed at a rear end of an ink containing tube 62. In addition, at the rear end of the ink containing tube 62, an air hole 63*a* is opened, through which air can flow between an inside of the ink containing tube 62 and an outside thereof.

A plurality of gaps 63*c*, each of which has a cutout pattern, are formed between the respective projection pieces 63*b*, so that the plurality of gaps 63*c* are radially communicated with the air hole 63*a*. Due to the plurality of gaps 63*c* and the air hole 63*a*, air can flow between the inside of the ink containing tube 62 and the outside thereof.

The other structure of the present embodiment is substantially the same as that of the first embodiment explained with reference to FIGS. 1 to 20. In FIG. 28, the same parts as those of the first embodiment are shown by the same reference numerals, and detailed explanation thereof is omitted.

According to the present embodiment, since the plurality of projection pieces 63 are integrally formed at the rear end of the ink containing tube 62, a rotation of the writing body 6 can be more surely obtained in conjunction with the rotation of the projection and retraction rotating member 7. In addition, it is possible to reduce the number of components, so that productivity can be improved.

A preferable method for integrally forming the plurality of projection pieces 63*b* and the ink containing tube 62 is a cutting process of the rear end portion of the ink containing tube 62. According to the cutting process, the shape of each projection piece 63*b* can be formed more surely, so that a rotation of the writing body 6 can be more surely obtained in conjunction with the rotation of the projection and retraction rotating member 7.

Another preferable method for integrally forming the plurality of projection pieces 63 and the ink containing tube 62 is an injection molding process of the ink containing tube 62. According to the injection molding process as well, the shape of each projection piece 63*b* can be formed more surely, so that a rotation of the writing body 6 can be more surely obtained in conjunction with the rotation of the projection and retraction rotating member 7. In addition, the projection pieces 63*b* can be integrally formed at the rear end pf the ink containing tube 62 at the same time as the injection molding process of the ink containing tube 62, so that productivity can be improved.

Structure of Third Embodiment

Figure 29:
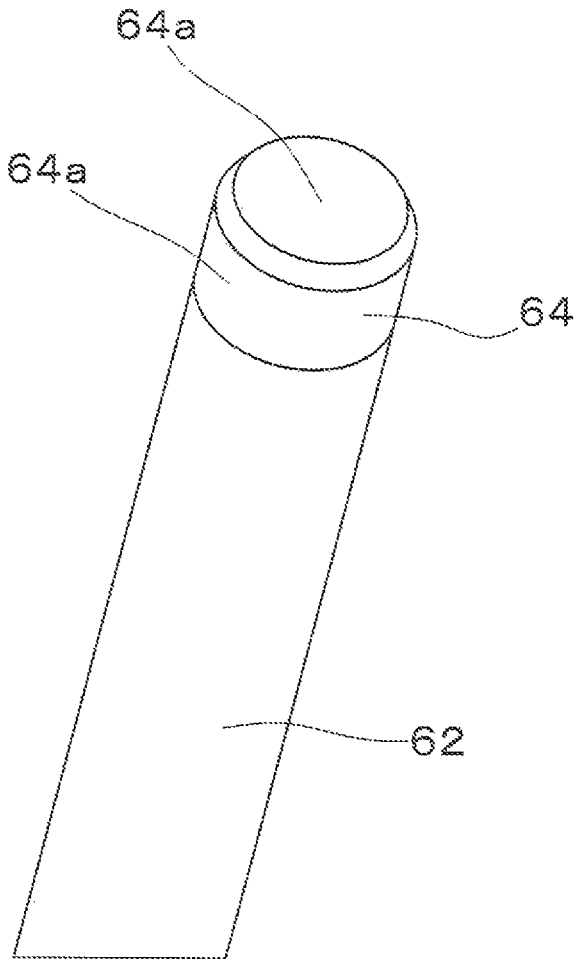
FIG. 29 is a perspective view of a rear end portion of a writing body according to the third embodiment of the present invention.
Figure 30:
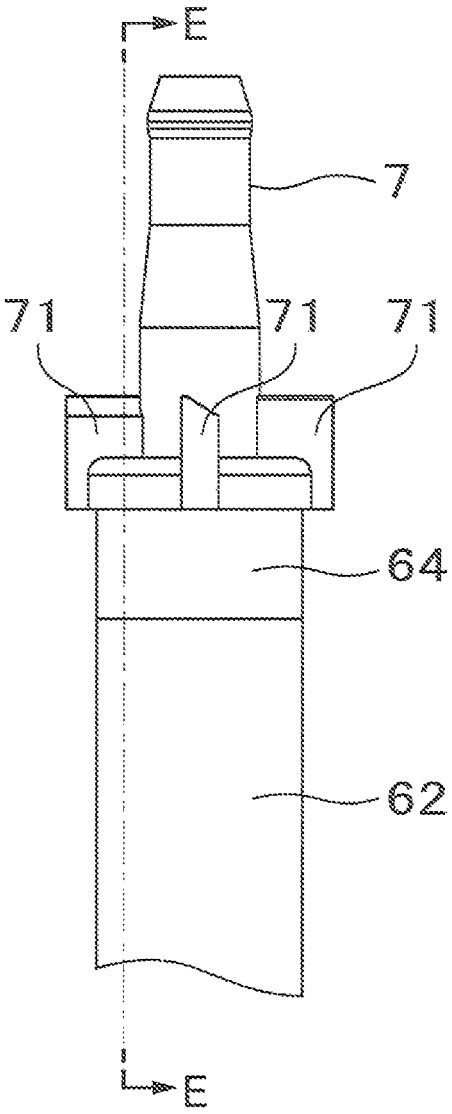
FIG. 30 is a front view showing an abutment state between a rear end of a writing body and a rotating member according to the third and fourth embodiments of the present invention.
Figure 31:
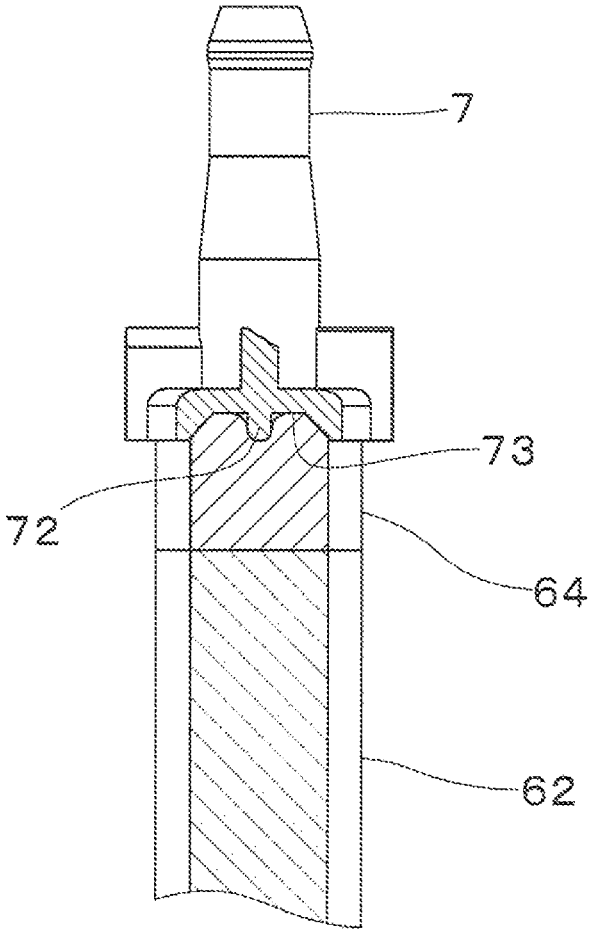
FIG. 31 is a section view taken along line E-E of FIG. 30 (a longitudinal section view showing the abutment state between the rear end of the writing body and the rotating member according to the third and fourth embodiments of the present invention)

Subsequently, FIG. 29 is a perspective view of a rear end portion of a writing body 6 according to the third embodiment of the present invention, FIG. 30 is a front view showing an abutment state between the projection and retraction rotating member 7 and the rear end of the writing body 6 of the third embodiment, and FIG. 31 is a section view taken along line E-E of FIG. 30.

In the same way as the knock type writing tool 1 of the first embodiment, the knock type writing tool of the present embodiment also includes: the writing body 6 having the pen tip 61 at the front end thereof, the thermochromic ink in the inside thereof, and the air hole 63*a* at the rear end thereof, the air hole 63*a* communicating with the space in which the thermochromic ink is contained; the shaft cylinder 2 configured to contain the writing body 6 in such a manner that the writing body 6 is movable in the front and rear direction with respect to the shaft cylinder 2; the knock member 8 provided on the outer surface of the shaft cylinder 2 in such a manner that the knock member 8 is movable in the front and rear direction with respect to the shaft cylinder 2; the projection and retraction rotating member 7 configured to move in the front and rear direction to cause the pen tip 61 to project from or retract within the front end of the shaft cylinder 2 and configured to cause the writing body 6 to rotate, every time the knock member 8 is moved forward; and the cam part 43 provided in the shaft cylinder 2, the cam part 43 being able to engage or disengage with the projection and retraction rotating member 7 depending on the position of the knock member 8; wherein the plurality of protrusion parts 72, each of which is protruded forward, are provided at the front portion of the projection and retraction rotating member 7.

On the other hand, in the present embodiment, a flexible member 64, which is elastically deformable, is provided at the rear end of the writing body 6 (so as to cover the air hole 63*a*). The flexible member 64 is a cylindrical member made of a porous material (for example, a porous body such as a sponge). The writing body 6 does not have a tail plug 63 nor a projection piece 63*b*.

Figure 32:
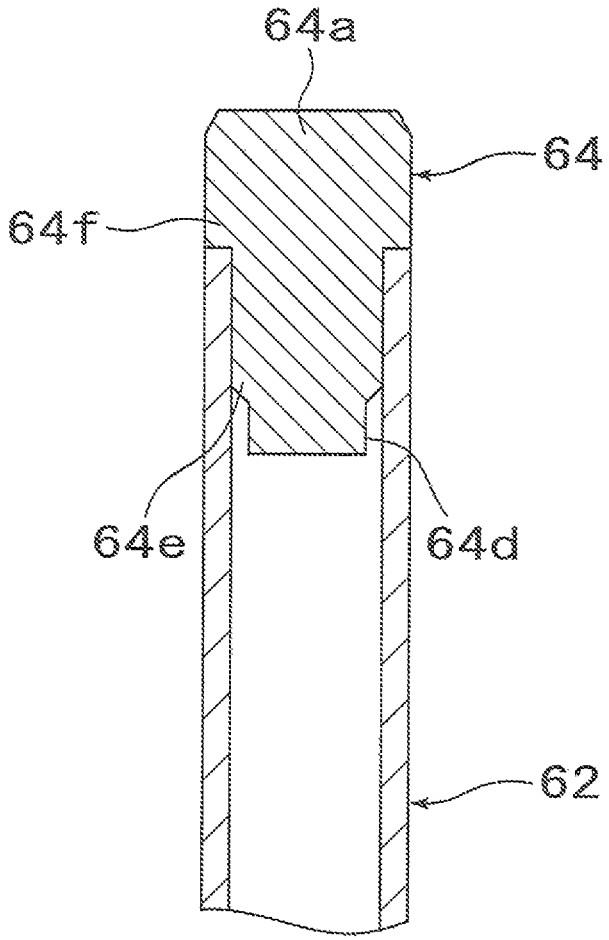
FIG. 32 is a section view of a flexible member according to the third embodiment of the present invention.

The flexible member 64 is porous, so that the flexible member 64 provides communication holes 64*a* (a large number of small communication holes 64*a*). In addition, as shown in FIG. 32, the flexible member 64 has: a thin diameter part 64*d* on a front side thereof; a small diameter part 64*e* in the middle thereof, and a large diameter part 64*f* on a rear side thereof. Under a state in which the flexible member 64 is attached to the ink containing tube 62, an outer surface of the small diameter part 64*e* is press-fitted into an inner surface of the rear end portion of the ink containing tube 62 and a front surface of the large diameter part 64*f* abuts on the rear end of the ink containing tube 62. Due to the communication holes 64*a*, air can flow between the inside of the ink containing tube 62 and the outside thereof.

The plurality of protrusion parts 72 and the flexible member 64 are configured to circumferentially engage with each other when the plurality of protrusion parts 72 cause the flexible member 64 to elastically deform with an aid of the biasing force of the spring body 9 and sink in an inside of the flexible member 64 (see FIGS. 30 and 31) in such a manner that the writing body 6 rotates in conjunction with a rotation of the projection and retraction rotating member 7.

The other structure of the present embodiment is substantially the same as that of the first embodiment explained with reference to FIGS. 1 to 20. In FIGS. 29 to 31, the same parts as those of the first embodiment are shown by the same reference numerals, and detailed explanation thereof is omitted.

According to the present embodiment, due to the flexible member 64 made of a porous material, air permeability can be secured sufficiently. Thus, an appropriate amount of air can be taken in depending on an amount of the thermochromic ink discharged from the pen tip 61, so that the thermochromic ink can be smoothly discharged from the pen tip 61. In addition, the flexible member 64 can absorb an impact and/or a force applied to the writing body 6 at the time of writing, and thus it is possible to provide a user with a soft and comfortable writing feeling.

In addition, according to the present embodiment, due to the elastically deforming of the flexible member 64, the flexible member 64 and the protrusion parts 72 are circumferentially engaged with each other more surely, and thus a rotation of the writing body 6 can be more surely obtained in conjunction with the rotation of the projection and retraction rotating member 7.

Furthermore, according to the present embodiment, for example when the writing body 6 falls down with the flexible member 64 facing downward, the elasticity of the flexible member 64 can protect the writing body 6 from an impact of the falling down.

In the present embodiment, the flexible member 64 may be integrally formed at the rear end of the ink containing tube 62. As a method for integrally forming the flexible member 64 and the ink containing tube 62, an adhesion, a welding, an insert molding or the like can be cited.

Variant of Third Embodiment

Figure 33:
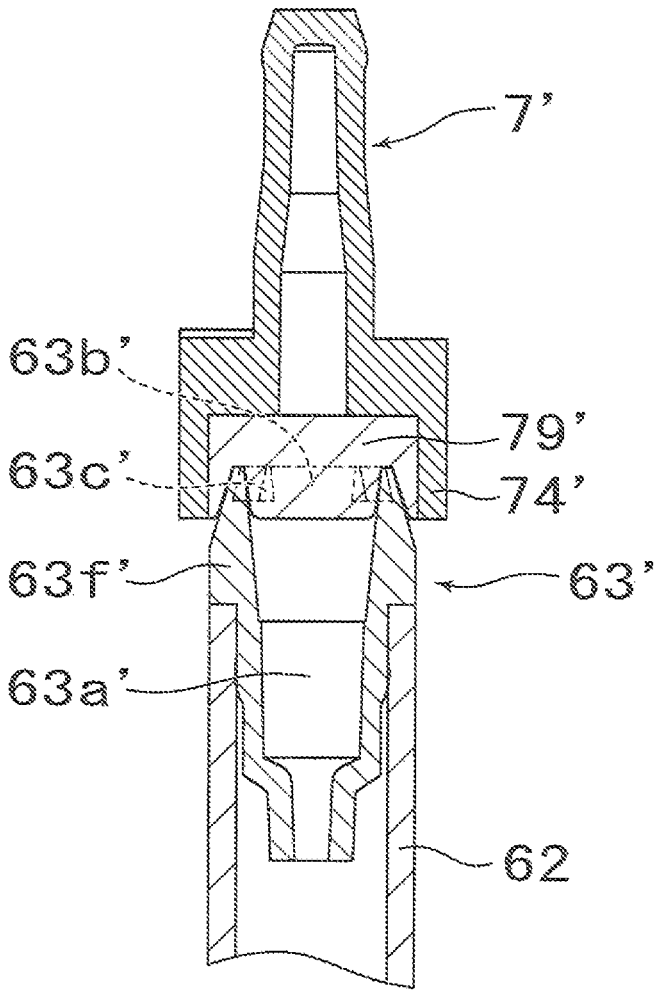
FIG. 33 is a view corresponding to FIG. 19 with regard to a variant of the third embodiment of the present invention.

In the third embodiment, the flexible member 64 is provided at the rear end portion of the writing body 6 while the same projection and retraction rotating member 7 as the first embodiment is used. However, as shown in FIG. 33, a flexible member may be provided at a front portion of a projection and retraction rotating member 7' while substantially the same projection pieces 63*b*' as the first embodiment are used.

In the same way as the knock type writing tool 1 of the first embodiment, the knock type writing tool of the present variant also includes: the writing body 6 having the pen tip 61 at the front end thereof, the thermochromic ink in the inside thereof, and the air hole 63*a* at the rear end thereof, the air hole 63*a*' communicating with the space in which the thermochromic ink is contained; the shaft cylinder 2 configured to contain the writing body 6 in such a manner that the writing body 6 is movable in the front and rear direction with respect to the shaft cylinder 2; the knock member 8 provided on the outer surface of the shaft cylinder 2 in such a manner that the knock member 8 is movable in the front and rear direction with respect to the shaft cylinder 2; the projection and retraction rotating member 7' configured to move in the front and rear direction to cause the pen tip 61 to project from or retract within the front end of the shaft cylinder 2 and configured to cause the writing body 6 to rotate, every time the knock member 8 is moved forward; and the cam part 43 provided in the shaft cylinder 2, the cam part 43 being able to engage or disengage with the projection and retraction rotating member 7' depending on the position of the knock member 8.

In the present variant, in substantially the same way as the first embodiment, the plurality of projection pieces 63*b*', each of which is projected rearward, are provided at the rear end of the writing body 6 more rearward than a flange part 63*f*', the plurality of projection pieces 63*b*' being arranged circumferentially apart from each other. The plurality of gaps 63*c*' between the plurality of projection pieces 63*b*' communicate with the air hole 63*a*'. However, the length of the projection pieces 63*b*' is shorter than the length of the projection pieces 63*b* in the first embodiment (see FIG. 19), and thus the length of the gaps 63*c*' is correspondingly shorter than the length of the gaps 63*c* in the first embodiment (see FIG. 19) (Instead, the length of the flange part 63*f'* is longer than the length of the flange part 63*f* in the first embodiment (see FIG. 19)).

On the other hand, in the present variant, a flexible member 79', which is elastically deformable, is provided at the front portion of the projection and retraction rotating member 7' in such a manner that the flexible member 79' is contained in an annular protrusion part 74'. For example, the flexible member 79' is made of a porous material (for example, a porous body such as a sponge).

The plurality of projection pieces 63*b'* and the flexible member 79' are configured to circumferentially engage with each other when at least a portion (the entire portion in the example shown in FIG. 33) on a rear side of the plurality of projection pieces 63*b'* causes the flexible member 79' to elastically deform with an aid of the biasing force of the spring body 9 and sinks in an inside of the flexible member 79' in such a manner that the writing body 6 rotates in conjunction with a rotation of the projection and retraction rotating member 7'.

According to the present variant as well, due to the flexible member 79' made of a porous material, air permeability can be secured sufficiently. Thus, an appropriate amount of air can be taken in depending on an amount of the thermochromic ink discharged from the pen tip 61, so that the thermochromic ink can be smoothly discharged from the pen tip 61. In addition, the flexible member 79' can absorb an impact and/or a force applied to the writing body 6 at the time of writing, and thus it is possible to provide a user with a soft and comfortable writing feeling.

In addition, according to the present variant as well, due to the elastically deforming of the flexible member 79', the flexible member 79' and the projection pieces 63*b'* are circumferentially engaged with each other more surely, and thus a rotation of the writing body 6 can be more surely obtained in conjunction with the rotation of the projection and retraction rotating member 7'.

Furthermore, according to the present variant as well, for example when the writing body 6 falls down with the flexible member 79' facing downward, the elasticity of the flexible member 79' can protect the writing body 6 from an impact of the falling down.

Structure of Fourth Embodiment

Figure 34:
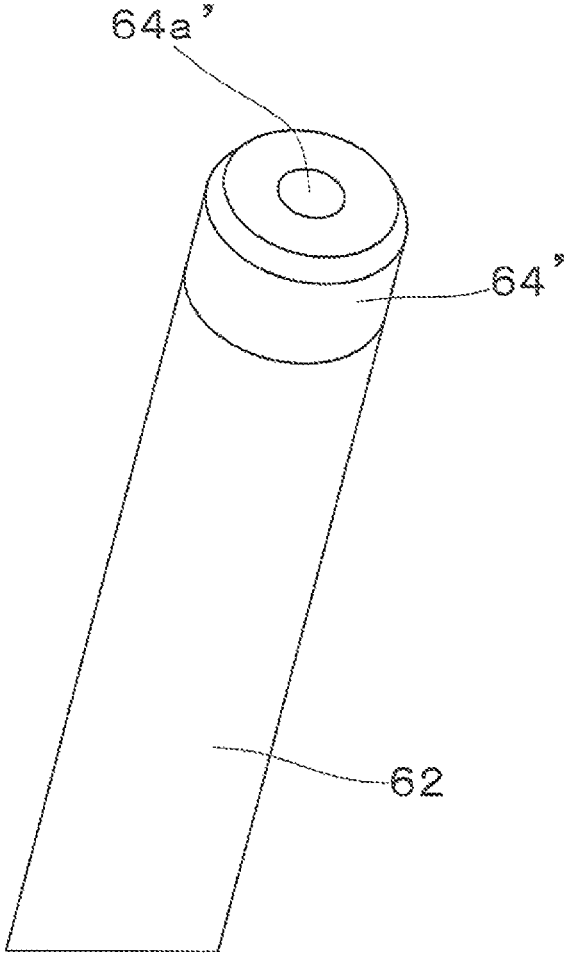
FIG. 34 is a perspective view of a rear end portion of a writing body according to the fourth embodiment of the present invention.

Subsequently, FIG. 34 is a perspective view of a rear end portion of a writing body according to the fourth embodiment of the present invention.

In the same way as the knock type writing tool 1 of the first embodiment, the knock type writing tool of the present embodiment also includes: the writing body 6 having the pen tip 61 at the front end thereof, the thermochromic ink in the inside thereof, and the air hole 63*a* at the rear end thereof, the air hole 63*a* communicating with the space in which the thermochromic ink is contained; the shaft cylinder 2 configured to contain the writing body 6 in such a manner that the writing body 6 is movable in the front and rear direction with respect to the shaft cylinder 2; the knock member 8 provided on the outer surface of the shaft cylinder 2 in such a manner that the knock member 8 is movable in the front and rear direction with respect to the shaft cylinder 2; the projection and retraction rotating member 7 configured to move in the front and rear direction to cause the pen tip 61 to project from or retract within the front end of the shaft cylinder 2 and configured to cause the writing body 6 to rotate, every time the knock member 8 is moved forward; and the cam part 43 provided in the shaft cylinder 2, the cam part 43 being able to engage or disengage with the projection and retraction rotating member 7 depending on the position of the knock member 8; wherein the plurality of protrusion parts 72, each of which is protruded forward, are provided at the front portion of the projection and retraction rotating member 7.

On the other hand, in the present embodiment, a flexible member 64', which is elastically deformable, is provided at the rear end of the writing body 6 (so as to cover the air hole 63*a*). The flexible member 64' is a cylindrical body formed by a molded body of a thermoplastic elastomer. The flexible member 64' has a communication hole 64*a'* (connection air hole) opened at a rear end thereof and extending in a front and rear direction (axial direction). The writing body 6 does not have a tail plug 63 nor a projection piece 63*b*.

Figure 35:
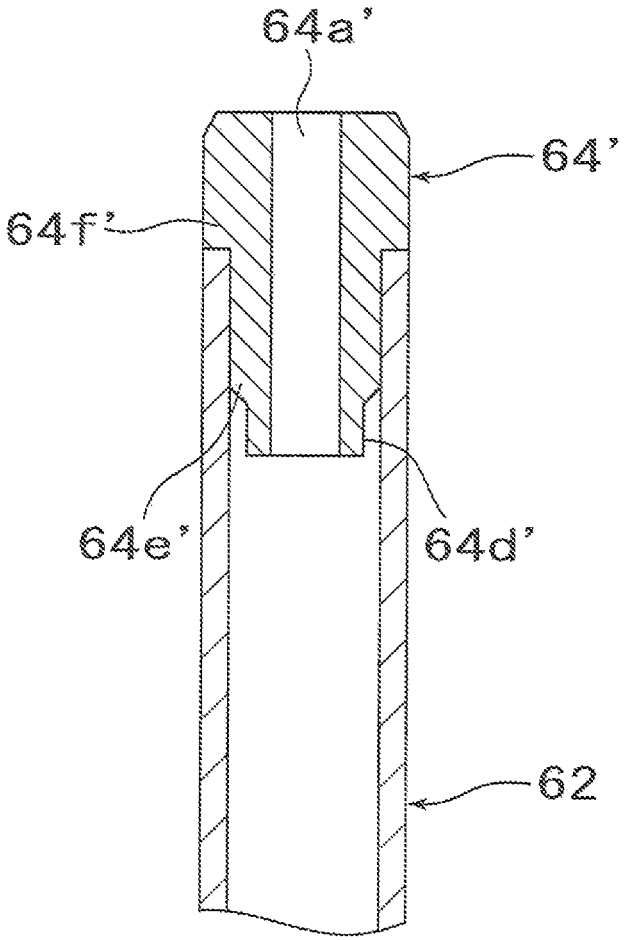
FIG. 35 is a section view of a flexible member according to the fourth embodiment of the present invention.

The communication hole 64*a'* of the flexible member 64' communicates with the air hole 63*a*. In addition, as shown in FIG. 35, the flexible member 64' also has: a thin diameter part 64*d'* on a front side thereof; a small diameter part 64*e'* in the middle thereof, and a large diameter part 64*f'* on a rear side thereof. Under a state in which the flexible member 64' is attached to the ink containing tube 62, an outer surface of the small diameter part 64*e'* is press-fitted into an inner surface of the rear end portion of the ink containing tube 62 and a front surface of the large diameter part 64*f'* abuts on the rear end of the ink containing tube 62. Due to the communication holes 64*a'*, aft can flow between the inside of the ink containing tube 62 and the outside thereof.

The plurality of protrusion parts 72 and the flexible member 64' are configured to circumferentially engage with each other when the plurality of protrusion parts 72 cause the flexible member 64' to elastically deform with an aid of the biasing force of the spring body 9 and sink in an inside of the flexible member 64' (see FIGS. 30 and 31) in such a manner that the writing body 6 rotates in conjunction with a rotation of the projection and retraction rotating member 7.

The other structure of the present embodiment is substantially the same as that of the first embodiment explained with reference to FIGS. 1 to 20. In FIG. 34, the same parts as those of the first embodiment are shown by the same reference numerals, and detailed explanation thereof is omitted.

According to the present embodiment, due to the communication hole 64*a'* of the flexible member 64', air permeability can be secured sufficiently. Thus, an appropriate amount of air can be taken in depending on an amount of the thermochromic ink discharged from the pen tip 61, so that the thermochromic ink can be smoothly discharged from the pen tip 61.

Even when the abutment parts 73 of the projection and retraction rotating member 7 abut on a rear end surface of the flexible member 64', a gap is formed between each protrusion part 72 and the flexible member 64', and the gap can function as an air communication hole. Thereby, aft permeability can be secured sufficiently.

In addition to the communication hole 64*a'* or instead of the communication hole 64*a'*, a lateral surface of the flexible member 64' may be provided with a lateral hole configured to communicate with the air hole 63*a*. The lateral hole may function as an aft communication hole (connection aft hole).

In addition, the flexible member 64' can absorb an impact and/or a force applied to the writing body 6 at the time of writing, and thus it is possible to provide a user with a soft and comfortable writing feeling.

In addition, according to the present embodiment, due to the elastically deforming of the flexible member 64', the flexible member 64" and the protrusion parts 72 are circumferentially engaged with each other more surely, and thus a rotation of the writing body 6 can be more surely obtained in conjunction with the rotation of the projection and retraction rotating member 7.

Furthermore, according to the present embodiment, for example when the writing body 6 falls down with the flexible member 64' facing downward, the elasticity of the flexible member 64' can protect the writing body 6 from an impact of the falling down.

In the present embodiment, the flexible member 64' may be integrally formed at the rear end of the ink containing tube 62. As a method for integrally forming the flexible member 64' and the ink containing tube 62, an adhesion, a welding, an insert molding or the like can be cited.

Variant of Fourth Embodiment

Figure 36:
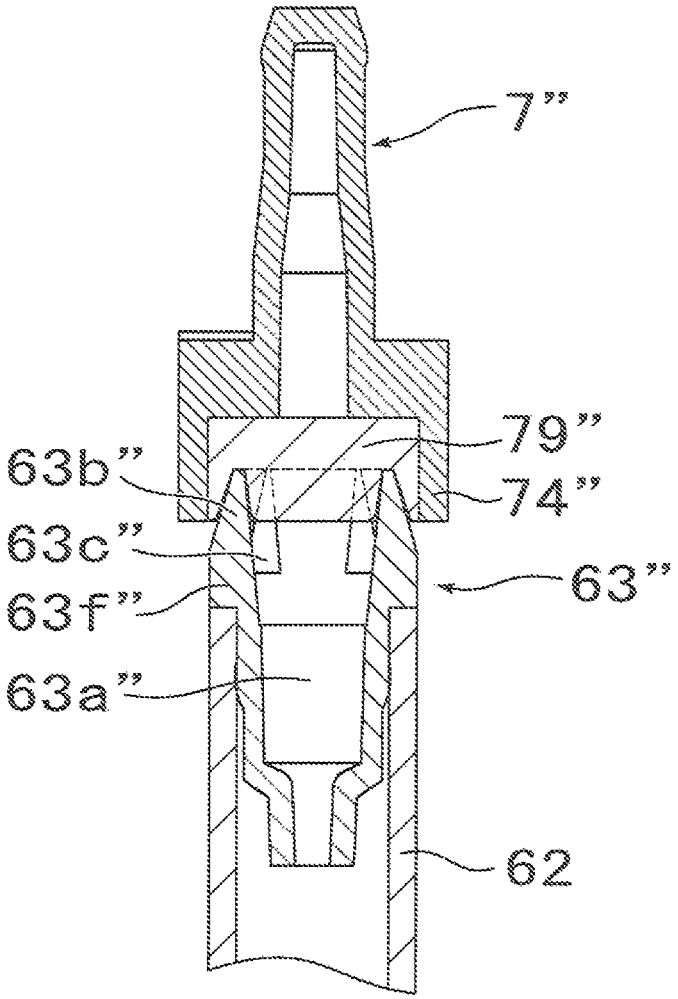
FIG. 36 is a view corresponding to FIG. 19 with regard to a variant of the fourth embodiment of the present invention.

In the fourth embodiment, the flexible member 64' is provided at the rear end portion of the writing body 6 while the same projection and retraction rotating member 7 as the first embodiment is used. However, as shown in FIG. 36, a flexible member may be provided at a front portion of a projection and retraction rotating member 7" while substantially the same projection pieces **63*b*"** as the first embodiment are used.

In the same way as the knock type writing tool 1 of the first embodiment, the knock type writing tool of the present variant also includes: the writing body 6 having the pen tip 61 at the front end thereof, the thermochromic ink in the inside thereof, and the air hole **63*a* at the rear end thereof, the air hole 63*a*" communicating with the space in which the thermochromic ink is contained; the shaft cylinder 2 configured to contain the writing body 6 in such a manner that the writing body 6 is movable in the front and rear direction with respect to the shaft cylinder 2; the knock member 8 provided on the outer surface of the shaft cylinder 2 in such a manner that the knock member 8 is movable in the front and rear direction with respect to the shaft cylinder 2; the projection and retraction rotating member 7" configured to move in the front and rear direction to cause the pen tip 61 to project from or retract within the front end of the shaft cylinder 2 and configured to cause the writing body 6 to rotate, every time the knock member 8 is moved forward; and the cam part 43 provided in the shaft cylinder 2, the cam part 43 being able to engage or disengage with the projection and retraction rotating member 7" depending on the position of the knock member 8**.

In the present variant, in substantially the same way as the first embodiment, the plurality of projection pieces **63*b*", each of which is projected rearward, are provided at the rear end of the writing body 6 more rearward than a flange part 63*f*", the plurality of projection pieces 63*b*" being arranged circumferentially apart from each other. The plurality of gaps 63*c*" between the plurality of projection pieces 63*b*" communicate with the air hole 63*a*"**.

On the other hand, in the present variant, a flexible member 79", which is elastically deformable, is provided at the front portion of the projection and retraction rotating member 7" in such a manner that the flexible member 79" is contained in an annular protrusion part 74". For example, the flexible member 79" is formed by a molded body of a thermoplastic elastomer.

The plurality of projection pieces **63*b*" and the flexible member 79" are configured to circumferentially engage with each other when a portion on a rear side of the plurality of projection pieces 63*b*" causes the flexible member 79" to elastically deform with an aid of the biasing force of the spring body 9 and sinks in an inside of the flexible member 79" in such a manner that the writing body 6 rotates in conjunction with a rotation of the projection and retraction rotating member 7"**.

According to the present variant, due to the gaps between the plurality of projection pieces **63*b*" on the front side (on the proximal side), air permeability can be secured sufficiently. Thus, an appropriate amount of air can be taken in depending on an amount of the thermochromic ink discharged from the pen tip 61, so that the thermochromic ink can be smoothly discharged from the pen tip 61. In addition, the flexible member 79" can absorb an impact and/or a force applied to the writing body 6** at the time of writing, and thus it is possible to provide a user with a soft and comfortable writing feeling.

In addition, according to the present variant as well, due to the elastically deforming of the flexible member 79", the flexible member 79" and the projection pieces **63*b*" are circumferentially engaged with each other more surely, and thus a rotation of the writing body 6 can be more surely obtained in conjunction with the rotation of the projection and retraction rotating member 7"**.

Furthermore, according to the present variant as well, for example when the writing body 6 falls down with the flexible member 79" facing downward, the elasticity of the flexible member 79" can protect the writing body 6 from an impact of the falling down.

EXPLANATION OF SIGN

1 knock type writing tool
2 shaft cylinder
3 front shaft
4 intermediate shaft
5 rear shaft
6 writing body
7 projection and retraction rotating member
7' projection and retraction rotating member
7" projection and retraction rotating member
8 knock member
9 spring body
21 slide hole
31 ferrule
**31*a*** front end hole
32 main body
33 holding part
41 first elongated hole
42 step part
43 cam part
**43*a*** cam tooth
**43*b*** cam groove
44 outward protrusion
51 second elongated hole
52 attachment hole
53 friction part
54 inward protrusion
61 pen tip
62 ink containing tube
63 tail plug
63' tail plug
**63*a*** air hole
**63*a*'** air hole
**63*a*"** air hole
**63*b*** projection piece
**63*b*'** projection piece
**63*b*"** projection piece

63*c* gap
63*c*' gap
63*c*" gap
63*d* smaller diameter part
63*e* larger diameter part
63*f* flange part
63*f*' flange part
63*f*" flange part
63*g* engagement surface
63*p* outward protrusion
63*t* auxiliary tapered portion
63*v* abutment part
64 flexible member
64' flexible member
64*a* communication hole
64*a*' communication hole
64*d* thin diameter part
64*d*' thin diameter part
64*e* small diameter part
64*e*' small diameter part
64*f* large diameter part
64*f*' large diameter part
71 ridge
72 protrusion part
72*a* engagement surface
72*c* gap
73 abutment part
74 annular auxiliary protrusion part
74' annular protrusion part
74" annular protrusion part
74*t* auxiliary abutment surface
78 outward protrusion
79' flexible member
79" flexible member
81 base part
82 shaft part
82*a* cam tooth
83 clip
83*a* ball part
88 inward protrusion

What is claimed is:

1. A knock type writing tool comprising:

a writing body having a pen tip at a front end thereof, a thermochromic ink in an inside thereof, and an air hole at a rear end thereof, the air hole communicating with a space in which the thermochromic ink is contained, a shaft cylinder configured to contain the writing body in such a manner that the writing body is movable in a front and rear direction with respect to the shaft cylinder, a knock member provided on an outer surface of the shaft cylinder in such a manner that the knock member is movable in a front and rear direction with respect to the shaft cylinder, a projection and retraction rotating member configured to move in a front and rear direction to cause the pen tip to project from or retract within a front end of the shaft cylinder and configured to cause the writing body to rotate, every time the knock member is moved forward, and a cam part provided in the shaft cylinder, the cam part being able to engage or disengage with the projection and retraction rotating member depending on a position of the knock member, wherein a plurality of projection pieces, each of which is projected rearward, are provided at a rear end of the writing body, the plurality of projection pieces being arranged circumferentially apart from each other, a plurality of gaps between the plurality of projection pieces communicate with the air hole, a front portion of the projection and retraction rotating member is provided with a plurality of abutment parts, on which respective rear ends of the plurality of projection pieces are to abut, and with a plurality of protrusion parts, each of which is protruded more forward than the plurality of abutment parts, the plurality of protrusion parts are respectively inserted in the plurality of gaps between the plurality of projection pieces, and a portion of each of the plurality of gaps is left in front of each of the plurality of protrusion parts.

2. The knock type writing tool according to claim 1, wherein the shaft cylinder is configured to contain the writing body in such a manner that the writing body is movable in the front and rear direction with respect to the shaft cylinder under a state in which the writing body is biased rearward, the projection and retraction rotating member is configured to move in the front and rear direction, in conjunction with a movement of the knock member in the front and rear direction, and the projection and retraction rotating member is configured to move forward together with the knock member and to cause the pen tip to project from or retract within the front end of the shaft cylinder, every time the knock member is moved forward.

3. The knock type writing tool according to claim 1, wherein the plurality of projection pieces and the plurality of protrusion parts are configured to circumferentially engage with each other in such a manner that the writing body rotates in conjunction with a rotation of the projection and retraction rotating member.

4. The knock type writing tool according to claim 3, wherein engagement surfaces of the plurality of projection pieces against the plurality of protrusion parts and engagement surfaces of the plurality of protrusion parts against the plurality of projection pieces extend substantially in parallel in a front and rear direction.

5. The knock type writing tool according to claim 1, wherein a front portion of the projection and retraction rotating member is connected to an annular auxiliary protrusion part provided integrally with the plurality of protrusion parts.

6. The knock type writing tool according to claim 5, wherein an inside surface of the annular auxiliary protrusion part is a tapered auxiliary abutment surface, and a rear end portion of the writing body is provided with an auxiliary tapered portion on which the auxiliary abutment surface is to abut.

7. The knock type writing tool according to claim 1, wherein the plurality of projection pieces are formed of polypropylene resin or polyethylene resin.

8. A knock type writing tool comprising:

a writing body having a pen tip at a front end thereof, a thermochromic ink in an inside thereof, and an air hole at a rear end thereof, the air hole communicating with a space in which the thermochromic ink is contained, a shaft cylinder configured to contain the writing body in such a manner that the writing body is movable in a front and rear direction with respect to the shaft cylinder, a knock member provided on an outer surface of the shaft cylinder in such a manner that the knock member is movable in a front and rear direction with respect to the shaft cylinder, a projection and retraction rotating member configured to move in a front and rear direction to cause the pen tip to project from or retract within a front end of the shaft cylinder and configured to cause the writing body to rotate, every time the knock member is moved forward, and a cam part provided in the shaft cylinder, the cam part being able to engage or disengage with the projection and retraction rotating member depending on a position of the knock member, wherein a plurality of protrusion parts, each of which is protruded forward, are provided at a front portion of the projection and retraction rotating member, the plurality of protrusion parts being arranged circumferentially apart from each other, a rear end of the writing body is provided with a plurality of abutment parts, on which respective front ends of the plurality of protrusion parts are to abut, and with a plurality of projection pieces, each of which is projected more rearward than the plurality of abutment parts, the plurality of projection pieces are respectively inserted in a plurality of gaps between the plurality of protrusion parts, and a portion of each of the plurality of gaps is left behind each of the plurality of projection pieces.

9. A knock type writing tool comprising:

a writing body having a pen tip at a front end thereof, a thermochromic ink in an inside thereof, and an air hole at a rear end thereof, the air hole communicating with a space in which the thermochromic ink is contained, a shaft cylinder configured to contain the writing body in such a manner that the writing body is movable in a front and rear direction with respect to the shaft cylinder, a knock member provided on an outer surface of the shaft cylinder in such a manner that the knock member is movable in a front and rear direction with respect to the shaft cylinder, a projection and retraction rotating member configured to move in a front and rear direction to cause the pen tip to project from or retract within a front end of the shaft cylinder and configured to cause the writing body to rotate, every time the knock member is moved forward, and a cam part provided in the shaft cylinder, the cam part being able to engage or disengage with the projection and retraction rotating member depending on a position of the knock member, wherein a plurality of protrusion parts, each of which is protruded forward, are provided at a front portion of the projection and retraction rotating member, a rear end of the writing body is provided with a flexible member which is elastically deformable, the flexible member is provided with a connection air hole configured to communicate with the air hole, the connection air hole being opened at a rear end or a lateral surface of the flexible member, and the plurality of protrusion parts and the flexible member are configured to circumferentially engage with each other when the plurality of protrusion parts cause the flexible member to elastically deform and sink in an inside of the flexible member in such a manner that the writing body rotates in conjunction with a rotation of the projection and retraction rotating member.

* * * * *